US010202833B2

(12) United States Patent
Willberg et al.

(10) Patent No.: US 10,202,833 B2
(45) Date of Patent: Feb. 12, 2019

(54) HYDRAULIC FRACTURING WITH EXOTHERMIC REACTION

(71) Applicant: Schlumberger Technology Corporation, Sugar Land, TX (US)

(72) Inventors: Dean M. Willberg, Salt Lake City, UT (US); James Ernest Brown, Fort Collins, CO (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 275 days.

(21) Appl. No.: 13/833,059

(22) Filed: Mar. 15, 2013

(65) Prior Publication Data

US 2014/0262249 A1 Sep. 18, 2014

(51) Int. Cl.
*E21B 43/243* (2006.01)
*E21B 43/247* (2006.01)

(52) U.S. Cl.
CPC ..... *E21B 43/247* (2013.01)

(58) Field of Classification Search
CPC ..... E21B 36/008; E21B 36/04; E21B 43/243; E21B 43/247
See application file for complete search history.

(56) References Cited

U.S. PATENT DOCUMENTS 3,937,283 A 2/1976 Blauer et al.
4,030,549 A 6/1977 Bouck
4,823,875 A 4/1989 Hill
5,518,996 A 5/1996 Maroy et al.
5,905,468 A 5/1999 Ikawa et al.
6,626,991 B1 9/2003 Drochon et al.
6,874,578 B1 4/2005 A Gamier et al.
6,885,918 B2 * 4/2005 Harmon et al. ..... 701/14
7,134,492 B2 * 11/2006 Willberg ..... E21B 47/00 166/250.1
7,255,169 B2 8/2007 van Batenburg et al.
7,275,596 B2 10/2007 Willberg et al.
7,393,423 B2 * 7/2008 Liu ..... 149/38
7,581,590 B2 9/2009 Lesko et al.
7,775,279 B2 8/2010 Marya et al.
7,784,541 B2 8/2010 Hartman et al.
7,789,146 B2 9/2010 Panga et al.
(Continued)

FOREIGN PATENT DOCUMENTS

CN 102879801 A 1/2013
DE 1996317 11/1968
(Continued)

OTHER PUBLICATIONS

International Search Report and Written Opinion issued in PCT/US2014/021662 dated Jun. 24, 2014, 15 pages.
(Continued)

*Primary Examiner* — Catherine Loikith
(74) *Attorney, Agent, or Firm* — Andrea E. Tran

(57) ABSTRACT

Methods of stimulating subterranean formations are given in which thermite is placed downhole and then ignited. The thermite may be ignited with a downhole tool, the fracture may be mapped, and the thermite-affected region of the formation may be reconnected to the surface after the thermite reaction through the original or a second wellbore.

19 Claims, 4 Drawing Sheets

(56) References Cited

U.S. PATENT DOCUMENTS

| | | | | |
|---|---|---|---|---|
| 7,879,721 | B2 * | 2/2011 | Gangopadhyay | H01L 35/30 438/660 |
| 8,008,234 | B2 | 8/2011 | Panga et al. | |
| 8,119,574 | B2 | 2/2012 | Panga et al. | |
| 8,210,249 | B2 | 7/2012 | Panga et al. | |
| 8,227,026 | B2 | 7/2012 | McDaniel et al. | |
| 8,234,072 | B2 | 7/2012 | Smith, Jr. et al. | |
| 8,371,383 | B2 | 2/2013 | Bell et al. | |
| 8,685,187 | B2 * | 4/2014 | Han | F42B 1/02 149/108.2 |
| 2008/0066909 | A1 * | 3/2008 | Hutchins et al. | 166/280.1 |
| 2008/0196896 | A1 | 8/2008 | Bustos et al. | |
| 2008/0283241 | A1 * | 11/2008 | Kaminsky | E21B 41/0064 166/245 |
| 2009/0159286 | A1 | 6/2009 | Prouvost et al. | |
| 2010/0252267 | A1 | 10/2010 | Harris et al. | |
| 2010/0300688 | A1 | 12/2010 | Panga et al. | |
| 2011/0139505 | A1 * | 6/2011 | Huang | E21B 43/117 175/2 |
| 2012/0000641 | A1 | 1/2012 | Panga et al. | |
| 2012/0111563 | A1 | 5/2012 | Abad et al. | |
| 2012/0132421 | A1 | 5/2012 | Loiseau et al. | |
| 2012/0138296 | A1 | 6/2012 | Panga et al. | |
| 2012/0305245 | A1 | 12/2012 | Loiseau et al. | |
| 2012/0305254 | A1 | 12/2012 | Chen et al. | |
| 2013/0233542 | A1 | 9/2013 | Shampine et al. | |
| 2013/0324444 | A1 | 12/2013 | Lesko et al. | |

FOREIGN PATENT DOCUMENTS

| | | |
|---|---|---|
| GB | 2277927 | 11/1994 |
| WO | 2009/046980 | 4/2009 |
| WO | 2011/050046 | 4/2011 |
| WO | 2012/054456 | 4/2012 |
| WO | 2013085412 A1 | 6/2013 |

OTHER PUBLICATIONS

Schlumberger CemCRETE Brochure (2003), and Schlumberger Cementing Services and Products—Materials, pp. 39-76 (2012), available at http://www.slb.com/~/media/Files/cementing/catalogs/05_cementing_materials.pdf.

"Fluid loss under static conditions," in Reservoir Stimulation, 3rd Edition, Schlumberger, John Wiley & Sons, Ltd., pp. 8-23 to 8-24, 2000.

L.L. Wang, Z.A. Munir, Y.M. Maximov, "Review Thermite reactions: their utilization in the synthesis and processing of materials," Journal of Materials Science 28 (14): 3693-3708, (1993).

Office Action issued in Chinese Patent Appl. No. 201480015600.3 dated Dec. 5, 2016; 17 pages (with English translation).

Office Action issued in Chinese Patent Application No. 201480015600.3 dated Sep. 15, 2017; 14 pages (with English translation).

* cited by examiner

HYDRAULIC FRACTURING WITH EXOTHERMIC REACTION

BACKGROUND

The statements in this section merely provide background information related to the present disclosure and may not constitute prior art.

This application broadly relates to stimulation of hydrocarbon production from subterranean formations. More particularly it relates to improving the flow path for hydrocarbons to flow to a wellbore from a formation having low permeability.

German Pat. No. 512,955 discloses an explosion process in which a thermite mixture within a waterproofed casing is placed in a bore hole, with water around the casing. After ignition of the aluminothermic mixture, great heat is released, causing the surrounding water to evaporate and superheat. The resulting vapor pressure causes scattering of the bore hole walls. This was intended not to fracture, but to enlarge the borehole.

SUMMARY

In some embodiments, methods of stimulating a subterranean formation penetrated by a wellbore through a wellhead are disclosed; the methods comprising fracturing the formation while introducing solids comprising thermite comprising a first metal and the oxide of a second metal into the fracture, and igniting the thermite to produce a thermite-affected region.

In some embodiments, the treatments, treatment fluids, systems, equipment, methods, and the like employ a pad or slickwater.

In some embodiments herein, the treatments, treatment fluids, systems, equipment, methods, and the like employ a stabilized treatment slurry (STS) wherein the solid phase, which may include proppant, is at least temporarily inhibited from gravitational settling in the fluid phase. In some embodiments, the STS may have an at least temporarily controlled rheology, such as, for example, viscosity, leakoff or yield strength, or other physical property, such as, for example, specific gravity, solids volume fraction (SVF), or the like. In some embodiments, the solids phase of the STS may have an at least temporarily controlled property, such as, for example, particle size distribution (including modality(ies)), packed volume fraction (PVF), density(ies), aspect ratio(s), sphericity(ies), roundness(es) (or angularity(ies)), strength(s), permeability(ies), solubility(ies), reactivity(ies), etc.

BRIEF DESCRIPTION OF THE DRAWINGS

These and other features and advantages will be better understood by reference to the following detailed description when considered in conjunction with the accompanying drawings.

DETAILED DESCRIPTION OF SOME ILLUSTRATIVE EMBODIMENTS

Figure 1:
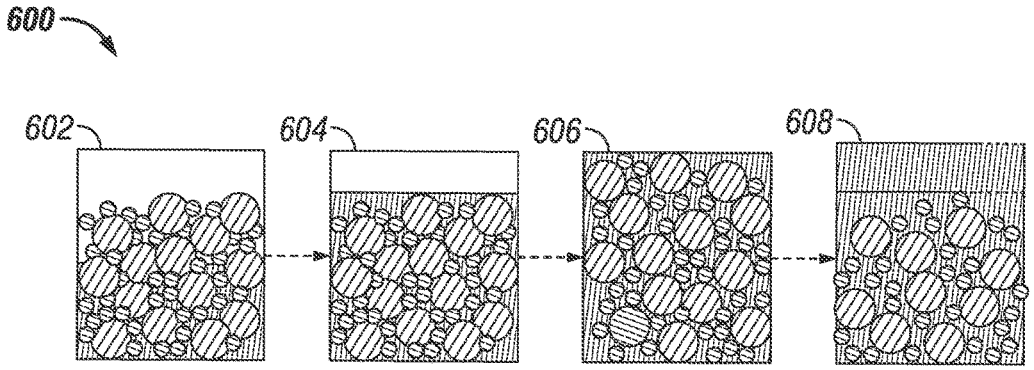
FIG. 1 shows a schematic slurry state progression chart for a treatment fluid according to some embodiments of the current application.

The following description aims at stimulation of hydrocarbon production from subterranean formations. It relates to improving the flow path for hydrocarbons to flow to a wellbore from a formation having low permeability by using a highly exothermic reaction to create a region of shattered rock and then connecting this region to a wellbore.

Hydraulic fracturing is a primary tool for improving well productivity by placing or extending highly conductive fractures from the wellbore into the reservoir. Conventional hydraulic fracturing treatments may be pumped in several distinct stages. During the first stage, sometimes referred to as the pad, a fluid is injected through a wellbore into a subterranean formation at high rates and pressures. The fluid injection rate exceeds the filtration rate (also called the leakoff rate) into the formation, producing increasing hydraulic pressure. When the pressure exceeds a threshold value, the formation cracks and fractures. The hydraulic fracture initiates and starts to propagate into the formation as injection of fluid continues.

During the next stage, proppant is mixed into the fluid, which is then called the fracture fluid, frac fluid, or fracturing fluid, and transported throughout the hydraulic fracture as it continues to grow. The pad fluid and the fracture fluid may be the same or different. The proppant is deposited in the fracture over the designed length, and mechanically prevents the fracture from closure after injection stops and the pressure is reduced. After the treatment, and once the well is put on production, the reservoir fluids flow into the fracture and filter through the permeable proppant pack to the wellbore. The fracturing fluid may be preceded or may comprise acid or acids precursors.

The rate and extent of production of reservoir fluids depends upon a number of parameters, such as formation permeability, proppant pack permeability, hydraulic pressure in the formation, properties of the production fluid, the shape of the fracture, etc. Typically, a single fracture is formed; multiple fractures are possible and methods have been developed to promote the creation of multiple fractures. However, the rate and extent of hydrocarbon production could be increased if rather than mere fractures, a large region of shattered rock were created and connected back to a conductive propped fracture or to the wellbore itself.

The present disclosure aim at methods of stimulating a subterranean formation penetrated by a wellbore through a wellhead. The methods involve fracturing the formation while introducing solids comprising thermite into the fracture, and igniting the thermite to produce a thermite-affected region.

In some embodiments, the methods of stimulating the subterranean formation penetrated by a wellbore through a wellhead involve fracturing the formation while introducing solids that comprising thermite into the fracture, igniting the thermite to produce a thermite-affected region, and ensuring that the thermite-affected region is fluidly-connected to the surface.

In some embodiments the methods of stimulating the subterranean formation penetrated by a wellbore through a wellhead comprise introducing solids comprising thermite into the fracture igniting the thermite to produce a thermite-affected region, and mapping the thermite-affected region.

For the purposes of promoting an understanding of the principles of the disclosure, reference will now be made to some illustrative embodiments of the current application. Like reference numerals used herein refer to like parts in the various drawings. Reference numerals without suffixed letters refer to the part(s) in general; reference numerals with suffixed letters refer to a specific one of the parts.

As used herein, "embodiments" refers to non-limiting examples of the application disclosed herein, whether claimed or not, which may be employed or present alone or in any combination or permutation with one or more other embodiments. Each embodiment disclosed herein should be regarded both as an added feature to be used with one or more other embodiments, as well as an alternative to be used separately or in lieu of one or more other embodiments. It should be understood that no limitation of the scope of the claimed subject matter is thereby intended, any alterations and further modifications in the illustrated embodiments, and any further applications of the principles of the application as illustrated therein as would normally occur to one skilled in the art to which the disclosure relates are contemplated herein.

Moreover, the schematic illustrations and descriptions provided herein are understood to be examples only, and components and operations may be combined or divided, and added or removed, as well as re-ordered in whole or part, unless stated explicitly to the contrary herein. Certain operations illustrated may be implemented by a computer executing a computer program product on a computer readable medium, where the computer program product comprises instructions causing the computer to execute one or more of the operations, or to issue commands to other devices to execute one or more of the operations.

It should be understood that, although a substantial portion of the following detailed description may be provided in the context of oilfield hydraulic fracturing operations, other oilfield operations such as cementing, gravel packing, etc., or even non-oilfield well treatment operations, can utilize and benefit as well from the disclosure of the present treatment slurry.

As used herein, the terms "treatment fluid" or "wellbore treatment fluid" are inclusive of "fracturing fluid" or "treatment slurry" and should be understood broadly. These may be or include a liquid, a solid, a gas, and combinations thereof, as will be appreciated by those skilled in the art. A treatment fluid may take the form of a solution, an emulsion, slurry, or any other form as will be appreciated by those skilled in the art.

As used herein, "slurry" refers to an optionally flowable mixture of particles dispersed in a fluid carrier. The terms "flowable" or "pumpable" or "mixable" are used interchangeably herein and refer to a fluid or slurry that has either a yield stress or low-shear (5.11 $s^{-1}$) viscosity less than 1000 Pa and a dynamic apparent viscosity of less than 10 Pa-s (10,000 cP) at a shear rate 170 $s^{-1}$, where yield stress, low-shear viscosity and dynamic apparent viscosity are measured at a temperature of 25° C. unless another temperature is specified explicitly or in context of use.

"Viscosity" as used herein unless otherwise indicated refers to the apparent dynamic viscosity of a fluid at a temperature of 25° C. and shear rate of 170 $s^{-1}$. "Low-shear viscosity" as used herein unless otherwise indicated refers to the apparent dynamic viscosity of a fluid at a temperature of 25° C. and shear rate of 5.11 $s^{-1}$. Yield stress and viscosity of the treatment fluid are evaluated at 25° C. in a Fann 35 rheometer with an R1B5F1 spindle, or an equivalent rheometer/spindle arrangement, with shear rate ramped up to 255 (300 rpm) and back down to 0, an average of the two readings at 2.55, 5.11, 85.0, 170 and 255 $s^{-1}$ (3, 6, 100, 200 and 300 rpm) recorded as the respective shear stress, the apparent dynamic viscosity is determined as the ratio of shear stress to shear rate $$(\tau/\gamma\gamma = \tau_0\tau = \tau_0 + k(\gamma)^n \tau k\gamma n)$$

is the power law exponent. Where the power law exponent is equal to 1, the Herschel-Buckley fluid is known as a Bingham plastic. Yield stress as used herein is synonymous with yield point and refers to the stress required to initiate flow in a Bingham plastic or Herschel-Buckley fluid system calculated as the y-intercept in the manner described herein. A "yield stress fluid" refers to a Herschel-Buckley fluid system, including Bingham plastics or another fluid system in which an applied non-zero stress as calculated in the manner described herein is required to initiate fluid flow.

The following conventions with respect to slurry terms are intended herein unless otherwise indicated explicitly or implicitly by context.

"Treatment fluid" or "fluid" (in context) refers to the entire treatment fluid, including any proppant, subproppant particles, liquid, gas etc. "Whole fluid," "total fluid" and "base fluid" are used herein to refer to the fluid phase plus any subproppant particles dispersed therein, but exclusive of proppant particles. "Carrier," "fluid phase" or "liquid phase" refer to the fluid or liquid that is present, which may comprise a continuous phase and optionally one or more discontinuous fluid phases dispersed in the continuous phase, including any solutes, thickeners or colloidal particles only, exclusive of other solid phase particles; reference to "water" in the slurry refers only to water and excludes any particles, solutes, thickeners, colloidal particles, etc.; reference to "aqueous phase" refers to a carrier phase comprised predominantly of water, which may be a continuous or dispersed phase. As used herein the terms "liquid" or "liquid phase" encompasses both liquids per se and supercritical fluids, including any solutes dissolved therein.

The measurement or determination of the viscosity of the liquid phase (as opposed to the treatment fluid or base fluid) may be based on a direct measurement of the solids-free liquid, or a calculation or correlation based on a measurement(s) of the characteristics or properties of the liquid containing the solids, or a measurement of the solids-containing liquid using a technique where the determination of viscosity is not affected by the presence of the solids. As used herein, solids-free for the purposes of determining the viscosity of the liquid phase means in the absence of non-colloidal particles larger than 1 micron such that the particles do not affect the viscosity determination, but in the presence of any submicron or colloidal particles that may be present to thicken and/or form a gel with the liquid, i.e., in the presence of ultrafine particles that can function as a thickening agent. In some embodiments, a "low viscosity liquid phase" means a viscosity less than about 300 mPa-s measured without any solids greater than 1 micron at 170 $s^{-1}$ and 25° C.

In some embodiments, the treatment fluid may include a continuous fluid phase, also referred to as an external phase, and a discontinuous phase(s), also referred to as an internal phase(s), which may be a fluid (liquid or gas) in the case of an emulsion, foam or energized fluid, or which may be a solid in the case of a slurry. The continuous fluid phase may be any matter that is substantially continuous under a given condition. Examples of the continuous fluid phase include, but are not limited to, water, hydrocarbon, gas, liquefied gas, etc., which may include solutes, e.g. the fluid phase may be a brine, and/or may include a brine or other solution(s). In some embodiments, the fluid phase(s) may optionally include a viscosifying and/or yield point agent and/or a portion of the total amount of viscosifying and/or yield point agent present. Some non-limiting examples of the fluid phase(s) include hydratable gels (e.g. gels containing polysaccharides such as guars, xanthan and diutan, hydroxyethylcellulose, polyvinyl alcohol, other hydratable polymers, colloids, etc.), a cross-linked hydratable gel, a viscosified acid (e.g. gel-based), an emulsified acid (e.g. oil outer phase), an energized fluid (e.g., an $N_2$ or $CO_2$ based foam), a viscoelastic surfactant (VES) viscosified fluid, and an oil-based fluid including a gelled, foamed, or otherwise viscosified oil.

The discontinuous phase if present in the treatment fluid may be any particles (including fluid droplets) that are suspended or otherwise dispersed in the continuous phase in a disjointed manner. In this respect, the discontinuous phase can also be referred to, collectively, as "particle" or "particulate" which may be used interchangeably. As used herein, the term "particle" should be construed broadly. For example, in some embodiments, the particle(s) of the current application are solid such as proppant, sands, ceramics, crystals, salts, etc.; however, in some other embodiments, the particle(s) can be liquid, gas, foam, emulsified droplets, etc. Moreover, in some embodiments, the particle(s) of the current application are substantially stable and do not change shape or form over an extended period of time, temperature, or pressure; in some other embodiments, the particle(s) of the current application are degradable, dissolvable, deformable, meltable, sublimeable, or otherwise capable of being changed in shape, state, or structure.

In certain embodiments, the particle(s) is substantially round and spherical. In some certain embodiments, the particle(s) is not substantially spherical and/or round, e.g., it can have varying degrees of sphericity and roundness, according to the API RP-60 sphericity and roundness index. For example, the particle(s) may have an aspect ratio, defined as the ratio of the longest dimension of the particle to the shortest dimension of the particle, of more than 2, 3, 4, 5 or 6. Examples of such non-spherical particles include, but are not limited to, fibers, flakes, discs, rods, stars, etc. All such variations should be considered within the scope of the current application.

The particles in the slurry in various embodiments may be multimodal. As used herein multimodal refers to a plurality of particle sizes or modes which each has a distinct size or particle size distribution, e.g., proppant and fines. As used herein, the terms distinct particle sizes, distinct particle size distribution, or multi-modes or multimodal, mean that each of the plurality of particles has a unique volume-averaged particle size distribution (PSD) mode. That is, statistically, the particle size distributions of different particles appear as distinct peaks (or "modes") in a continuous probability distribution function. For example, a mixture of two particles having normal distribution of particle sizes with similar variability is considered a bimodal particle mixture if their respective means differ by more than the sum of their respective standard deviations, and/or if their respective means differ by a statistically significant amount. In certain embodiments, the particles contain a bimodal mixture of two particles; in certain other embodiments, the particles contain a trimodal mixture of three particles; in certain additional embodiments, the particles contain a tetramodal mixture of four particles; in certain further embodiments, the particles contain a pentamodal mixture of five particles, and so on. Representative references disclosing multimodal particle mixtures include U.S. Pat. No. 5,518,996, U.S. Pat. No. 7,784,541, U.S. Pat. No. 7,789,146, U.S. Pat. No. 8,008,234, U.S. Pat. No. 8,119,574, U.S. Pat. No. 8,210,249, US 2010/0300688, US 2012/0000641, US 2012/0138296, US 2012/0132421, US 2012/0111563, WO 2012/054456, US 2012/0305245, US 2012/0305254, US 2012/0132421, PCT/RU2011/000971 and U.S. Ser. No. 13/415,025, each of which are hereby incorporated herein by reference.

"Solids" and "solids volume" refer to all solids present in the slurry, including proppant and subproppant particles, including particulate thickeners such as colloids and submicron particles. "Solids-free" and similar terms generally exclude proppant and subproppant particles, except particulate thickeners such as colloids for the purposes of determining the viscosity of a "solids-free" fluid. "Proppant" refers to particulates that are used in well work-overs and treatments, such as hydraulic fracturing operations, to hold fractures open following the treatment, of a particle size mode or modes in the slurry having a weight average mean particle size greater than or equal to about 100 microns, e.g., 140 mesh particles correspond to a size of 105 microns, unless a different proppant size is indicated in the claim or a smaller proppant size is indicated in a claim depending therefrom. "Gravel" refers to particles used in gravel packing, and the term is synonymous with proppant as used herein. "Sub-proppant" or "subproppant" refers to particles or particle size or mode (including colloidal and submicron particles) having a smaller size than the proppant mode(s); references to "proppant" exclude subproppant particles and vice versa. In some embodiments, the sub-proppant mode or modes each have a weight average mean particle size less than or equal to about one-half of the weight average mean particle size of a smallest one of the proppant modes, e.g., a suspensive/stabilizing mode.

The proppant, when present, can be naturally occurring materials, such as sand grains. The proppant, when present, can also be man-made or specially engineered, such as coated (including resin-coated) sand, modulus of various nuts, high-strength ceramic materials like sintered bauxite, etc. In some embodiments, the proppant of the current application, when present, has a density greater than 2.45 g/mL, e.g., 2.5-2.8 g/mL, such as sand, ceramic, sintered bauxite or resin coated proppant. In some embodiments, the proppant of the current application, when present, has a density less than or equal to 2.45 g/mL, such as less than about 1.60 g/mL, less than about 1.50 g/mL, less than about 1.40 g/mL, less than about 1.30 g/mL, less than about 1.20 g/mL, less than 1.10 g/mL, or less than 1.00 g/mL, such as light/ultralight proppant from various manufacturers, e.g., hollow proppant.

In some embodiments, the treatment fluid comprises an apparent specific gravity greater than 1.3, greater than 1.4, greater than 1.5, greater than 1.6, greater than 1.7, greater than 1.8, greater than 1.9, greater than 2, greater than 2.1, greater than 2.2, greater than 2.3, greater than 2.4, greater than 2.5, greater than 2.6, greater than 2.7, greater than 2.8, greater than 2.9, or greater than 3. The treatment fluid density can be selected by selecting the specific gravity and amount of the dispersed solids and/or adding a weighting solute to the aqueous phase, such as, for example, a compatible organic or mineral salt. In some embodiments, the aqueous or other liquid phase may have a specific gravity greater than 1, greater than 1.05, greater than 1.1, greater than 1.2, greater than 1.3, greater than 1.4, greater than 1.5, greater than 1.6, greater than 1.7, greater than 1.8, greater than 1.9, greater than 2, greater than 2.1, greater than 2.2, greater than 2.3, greater than 2.4, greater than 2.5, greater than 2.6, greater than 2.7, greater than 2.8, greater than 2.9, or greater than 3, etc. In some embodiments, the aqueous or other liquid phase may have a specific gravity less than 1. In embodiments, the weight of the treatment fluid can provide additional hydrostatic head pressurization in the wellbore at the perforations or other fracture location, and can also facilitate stability by lessening the density differences between the larger solids and the whole remaining fluid. In other embodiments, a low density proppant may be used in the treatment, for example, lightweight proppant (apparent specific gravity less than 2.65) having a density less than or equal to 2.5 g/mL, such as less than about 2 g/mL, less than about 1.8 g/mL, less than about 1.6 g/mL, less than about 1.4 g/mL, less than about 1.2 g/mL, less than 1.1 g/mL, or less than 1 g/mL. In other embodiments, the proppant or other particles in the slurry may have a specific gravity greater than 2.6, greater than 2.7, greater than 2.8, greater than 2.9, greater than 3, etc.

In the present context, thermite is to be understood as a composition of a metal powder and a metal oxide that produces an exothermic oxidation-reduction reaction. The thermites may be a diverse class of compositions. Some metal powders that may be used are aluminum, magnesium, titanium, zinc, silicon, boron, and mixtures thereof. Thermite mixtures from aluminum are interesting because of their high boiling point. The oxidizers may be boron (III) oxide, silicon (IV) oxide, chromium (III) oxide, manganese (IV) oxide, iron (III) oxide, iron (II,III) oxide, copper (II) oxide, and lead (II,III,IV) oxide, and mixtures thereof. A thermite reaction is the oxidation of a low-melting reactive first metal by the oxide of a second metal. Thermite is the mixture containing the two compounds. The products are the oxide of the first metal, the second metal as a free element, and a large amount of heat. The thermite may be a mixture of iron oxide (such as powdered ferric oxide, $Fe_2O_3$) and aluminum (preferably granular); the products in this case would be aluminum oxide, molten iron (which forms slag when cooled), and heat. Aluminum is convenient because it is inexpensive and has a low melting point and a high boiling point; magnesium may also be used. Aluminum alloys (for example with magnesium) may also be used. Other oxides, for example cuprous oxide, cupric oxide, ferrous oxide, magnetite $Fe_3O_4$, cobalt oxide, zinc oxide, lead oxide, nickel oxide, lead dioxide, lead tetroxide, manganese dioxide, stannous oxide, and chromium oxide, or mixtures of these oxides, are also used. Pyronol may be used. Pyronol is a mixture of (1) nickel, (2) one or more of the metal oxides above, and (3) a component selected from (a) aluminum and (b) a mixture of at least 50 weight percent aluminum and a metal that is magnesium, zirconium, bismuth, beryllium, boron, or mixtures of these metals.

An exemplary chemical reaction for thermite with aluminum being the metal and iron the oxide may be:

$$Fe_2O_3+2Al \rightarrow 2Fe+Al_2O_3$$

A more thorough description of Thermite may be found in DE 96317.

"Stable" or "stabilized" or similar terms refer to a stabilized treatment slurry (STS) wherein gravitational settling of the particles is inhibited such that no or minimal free liquid is formed, and/or there is no or minimal rheological variation among strata at different depths in the STS, and/or the slurry may generally be regarded as stable over the duration of expected STS storage and use conditions, e.g., an STS that passes a stability test or an equivalent thereof. In certain embodiments, stability can be evaluated following different settling conditions, such as for example static under gravity alone, or dynamic under a vibratory influence, or dynamic-static conditions employing at least one dynamic settling condition followed and/or preceded by at least one static settling condition.

The static settling test conditions can include gravity settling for a specified period, e.g., 24 hours, 48 hours, 72 hours, or the like, which are generally referred to with the respective shorthand notation "24 h-static", "48 h-static" or "72 h static". Dynamic settling test conditions generally indicate the vibratory frequency and duration, e.g., 4 h@15 Hz (4 hours at 15 Hz), 8 h@5 Hz (8 hours at 5 Hz), or the like. Dynamic settling test conditions are at a vibratory amplitude of 1 mm vertical displacement unless otherwise indicated. Dynamic-static settling test conditions will indicate the settling history preceding analysis including the total duration of vibration and the final period of static conditions, e.g., 4 h@15 Hz/20 h-static refers to 4 hours vibration followed by 20 hours static, or 8 h@15 Hz/10 d-static refers to 8 hours total vibration, e.g., 4 hours vibration followed by 20 hours static followed by 4 hours vibration, followed by 10 days of static conditions. In the absence of a contrary indication, the designation "8 h@15 Hz/10 d-static" refers to the test conditions of 4 hours vibration, followed by 20 hours static followed by 4 hours vibration, followed by 10 days of static conditions. In the absence of specified settling conditions, the settling condition is 72 hours static. The stability settling and test conditions are at 25° C. unless otherwise specified.

In certain embodiments, one stability test is referred to herein as the "8 h@15 Hz/10 d-static STS stability test", wherein a slurry sample is evaluated in a rheometer at the beginning of the test and compared against different strata of a slurry sample placed and sealed in a 152 mm (6 in.) diameter vertical gravitational settling column filled to a depth of 2.13 m (7 ft), vibrated at 15 Hz with a 1 mm amplitude (vertical displacement) two 4-hour periods the first and second settling days, and thereafter maintained in a static condition for 10 days (12 days total settling time). The 15 Hz/1 mm amplitude condition in this test is selected to correspond to surface transportation and/or storage conditions prior to the well treatment. At the end of the settling period the depth of any free water at the top of the column is measured, and samples obtained, in order from the top sampling port down to the bottom, through 25.4-mm sampling ports located on the settling column at 190 mm (6'3"), 140 mm (4'7"), 84 mm (2'9") and 33 mm (1'1"), and rheologically evaluated for viscosity and yield stress as described above.

As used herein, a stabilized treatment slurry (STS) may meet at least one of the following conditions:

(1) the slurry has a low-shear viscosity equal to or greater than 1 Pa-s (5.11 $s^{-1}$, 25° C.);

(2) the slurry has a Herschel-Buckley (including Bingham plastic) yield stress (as determined in the manner described herein) equal to or greater than 1 Pa; or (3) the largest particle mode in the slurry has a static settling rate less than 0.01 mm/hr; or (4) the depth of any free fluid at the end of a 72-hour static settling test condition or an 8 h@15 Hz/10 d-static dynamic settling test condition (4 hours vibration followed by 20 hours static followed by 4 hours vibration followed finally by 10 days of static conditions) is no more than 2% of total depth; or (5) the apparent dynamic viscosity (25° C., 170 $s^{-1}$) across column strata after the 72-hour static settling test condition or the 8 h@15 Hz/10 d-static dynamic settling test condition is no more than +/−20% of the initial dynamic viscosity; or (6) the slurry solids volume fraction (SVF) across the column strata below any free water layer after the 72-hour static settling test condition or the 8 h@15 Hz/10 d-static dynamic settling test condition is no more than 5% greater than the initial SVF; or (7) the density across the column strata below any free water layer after the 72-hour static settling test condition or the 8 h@15 Hz/10 d-static dynamic settling test condition is no more than 1% of the initial density.

In embodiments, the depth of any free fluid at the end of the 8 h@15 Hz/10 d-static dynamic settling test condition is no more than 2% of total depth, the apparent dynamic viscosity (25° C., 170 $s^{-1}$) across column strata after the 8 h@15 Hz/10 d-static dynamic settling test condition is no more than +/−20% of the initial dynamic viscosity, the slurry solids volume fraction (SVF) across the column strata below any free water layer after the 8 h@15 Hz/10 d-static dynamic settling test condition is no more than 5% greater than the initial SVF, and the density across the column strata below any free water layer after the 8 h@15 Hz/10 d-static dynamic settling test condition is no more than 1% of the initial density.

In some embodiments, the treatment slurry comprises at least one of the following stability indicia: (1) an SVF of at least 0.4 up to SVF=PVF; (2) a low-shear viscosity of at least 1 Pa-s (5.11 $s^{-1}$, 25° C.); (3) a yield stress (as determined herein) of at least 1 Pa; (4) an apparent viscosity of at least 50 mPa-s (170 $s^{-1}$, 25° C.); (5) a multimodal solids phase; (6) a solids phase having a PVF greater than 0.7; (7) a viscosifier selected from viscoelastic surfactants, in an amount ranging from 0.01 up to 7.2 g/L (60 ppt), and hydratable gelling agents in an amount ranging from 0.01 up to 4.8 g/L (40 ppt) based on the volume of fluid phase; (8) colloidal particles; (9) a particle-fluid density delta less than 1.6 g/mL, (e.g., particles having a specific gravity less than 2.65 g/mL, carrier fluid having a density greater than 1.05 g/mL or a combination thereof); (10) particles having an aspect ratio of at least 6; (11) ciliated or coated proppant; and (12) combinations thereof.

In some embodiments, the stabilized slurry comprises at least two of the stability indicia, such as for example, the SVF of at least 0.4 and the low-shear viscosity of at least 1 Pa-s (5.11 $s^{-1}$, 25° C.); and optionally one or more of the yield stress of at least 1 Pa, the apparent viscosity of at least 50 mPa-s (170 $s^{-1}$, 25° C.), the multimodal solids phase, the solids phase having a PVF greater than 0.7, the viscosifier, the colloidal particles, the particle-fluid density delta less than 1.6 g/mL, the particles having an aspect ratio of at least 6, the ciliated or coated proppant, or a combination thereof.

In some embodiments, the stabilized slurry comprises at least three of the stability indicia, such as for example, the SVF of at least 0.4, the low-shear viscosity of at least 1 Pa-s (5.11 $s^{-1}$, 25° C.) and the yield stress of at least 1 Pa; and optionally one or more of the apparent viscosity of at least 50 mPa-s (170 $s^{-1}$, 25° C.), the multimodal solids phase, the solids phase having a PVF greater than 0.7, the viscosifier, the colloidal particles, the particle-fluid density delta less than 1.6 g/mL, the particles having an aspect ratio of at least 6, the ciliated or coated proppant, or a combination thereof.

In some embodiments, the stabilized slurry comprises at least four of the stability indicia, such as for example, the SVF of at least 0.4, the low-shear viscosity of at least 1 Pa-s (5.11 $s^{-1}$, 25° C.), the yield stress of at least 1 Pa and the apparent viscosity of at least 50 mPa-s (170 $s^{-1}$, 25° C.); and optionally one or more of the multimodal solids phase, the solids phase having a PVF greater than 0.7, the viscosifier, colloidal particles, the particle-fluid density delta less than 1.6 g/mL, the particles having an aspect ratio of at least 6, the ciliated or coated proppant, or a combination thereof.

In some embodiments, the stabilized slurry comprises at least five of the stability indicia, such as for example, the SVF of at least 0.4, the low-shear viscosity of at least 1 Pa-s (5.11 $s^{-1}$, 25° C.), the yield stress of at least 1 Pa, the apparent viscosity of at least 50 mPa-s (170 $s^{-1}$, 25° C.) and the multimodal solids phase, and optionally one or more of the solids phase having a PVF greater than 0.7, the viscosifier, colloidal particles, the particle-fluid density delta less than 1.6 g/mL, the particles having an aspect ratio of at least 6, the ciliated or coated proppant, or a combination thereof.

In some embodiments, the stabilized slurry comprises at least six of the stability indicia, such as for example, the SVF of at least 0.4, the low-shear viscosity of at least 1 Pa-s (5.11 $s^{-1}$, 25° C.), the yield stress of at least 1 Pa, the apparent viscosity of at least 50 mPa-s (170 $s^{-1}$, 25° C.), the multimodal solids phase and one or more of the solids phase having a PVF greater than 0.7, and optionally the viscosifier, colloidal particles, the particle-fluid density delta less than 1.6 g/mL, the particles having an aspect ratio of at least 6, the ciliated or coated proppant, or a combination thereof.

In embodiments, the treatment slurry is formed (stabilized) by at least one of the following slurry stabilization operations: (1) introducing sufficient particles into the slurry or treatment fluid to increase the SVF of the treatment fluid to at least 0.4; (2) increasing a low-shear viscosity of the slurry or treatment fluid to at least 1 Pa-s (5.11 $s^{-1}$, 25° C.); (3) increasing a yield stress of the slurry or treatment fluid to at least 1 Pa; (4) increasing apparent viscosity of the slurry or treatment fluid to at least 50 mPa-s (170 $s^{-1}$, 25° C.); (5) introducing a multimodal solids phase into the slurry or treatment fluid; (6) introducing a solids phase having a PVF greater than 0.7 into the slurry or treatment fluid; (7) introducing into the slurry or treatment fluid a viscosifier selected from viscoelastic surfactants, e.g., in an amount ranging from 0.01 up to 7.2 g/L (60 ppt), and hydratable gelling agents, e.g., in an amount ranging from 0.01 up to 4.8 g/L (40 ppt) based on the volume of fluid phase; (8) introducing colloidal particles into the slurry or treatment fluid; (9) reducing a particle-fluid density delta to less than 1.6 g/mL (e.g., introducing particles having a specific gravity less than 2.65 g/mL, carrier fluid having a density greater than 1.05 g/mL or a combination thereof); (10) introducing particles into the slurry or treatment fluid having an aspect ratio of at least 6; (11) introducing ciliated or coated proppant into slurry or treatment fluid; and (12) combinations thereof. The slurry stabilization operations may be separate or concurrent, e.g., introducing a single viscosifier may also increase low-shear viscosity, yield stress, apparent viscosity, etc., or alternatively or additionally with respect to a viscosifier, separate agents may be added to increase low-shear viscosity, yield stress and/or apparent viscosity.

The techniques to stabilize particle settling in various embodiments herein may use any one, or a combination of any two or three, or all of these approaches, i.e., a manipulation of particle/fluid density, carrier fluid viscosity, solids fraction, yield stress, and/or may use another approach. In embodiments, the stabilized slurry is formed by at least two of the slurry stabilization operations, such as, for example, increasing the SVF and increasing the low-shear viscosity of the treatment fluid, and optionally one or more of increasing the yield stress, increasing the apparent viscosity, introducing the multimodal solids phase, introducing the solids phase having the PVF greater than 0.7, introducing the viscosifier, introducing the colloidal particles, reducing the particle-fluid density delta, introducing the particles having the aspect ratio of at least 6, introducing the ciliated or coated proppant or a combination thereof.

In embodiments, the stabilized slurry is formed by at least three of the slurry stabilization operations, such as, for example, increasing the SVF, increasing the low-shear viscosity and introducing the multimodal solids phase, and optionally one or more of increasing the yield stress, increasing the apparent viscosity, introducing the solids phase having the PVF greater than 0.7, introducing the viscosifier, introducing the colloidal particles, reducing the particle-fluid density delta, introducing the particles having the aspect ratio of at least 6, introducing the ciliated or coated proppant or a combination thereof.

In embodiments, the stabilized slurry is formed by at least four of the slurry stabilization operations, such as, for example, increasing the SVF, increasing the low-shear viscosity, increasing the yield stress and increasing apparent viscosity, and optionally one or more of introducing the multimodal solids phase, introducing the solids phase having the PVF greater than 0.7, introducing the viscosifier, introducing colloidal particles, reducing the particle-fluid density delta, introducing particles into the treatment fluid having the aspect ratio of at least 6, introducing the ciliated or coated proppant or a combination thereof.

In embodiments, the stabilized slurry is formed by at least five of the slurry stabilization operations, such as, for example, increasing the SVF, increasing the low-shear viscosity, increasing the yield stress, increasing the apparent viscosity and introducing the multimodal solids phase, and optionally one or more of introducing the solids phase having the PVF greater than 0.7, introducing the viscosifier, introducing colloidal particles, reducing the particle-fluid density delta, introducing particles into the treatment fluid having the aspect ratio of at least 6, introducing the ciliated or coated proppant or a combination thereof.

Decreasing the density difference between the particle and the carrier fluid may be done in embodiments by employing porous particles, including particles with an internal porosity, i.e., hollow particles. However, the porosity may also have a direct influence on the mechanical properties of the particle, e.g., the elastic modulus, which may also decrease significantly with an increase in porosity. In certain embodiments employing particle porosity, care should be taken so that the crush strength of the particles exceeds the maximum expected stress for the particle, e.g., in the embodiments of proppants placed in a fracture the overburden stress of the subterranean formation in which it is to be used should not exceed the crush strength of the proppants.

In embodiments, yield stress fluids, and also fluids having a high low-shear viscosity, are used to retard the motion of the carrier fluid and thus retard particle settling. The gravitational stress exerted by the particle at rest on the fluid beneath it must generally exceed the yield stress of the fluid to initiate fluid flow and thus settling onset. For a single particle of density 2.7 g/mL and diameter of 600 μm settling in a yield stress fluid phase of 1 g/mL, the critical fluid yield stress, i.e., the minimum yield stress to prevent settling onset, in this example is 1 Pa. The critical fluid yield stress might be higher for larger particles, including particles with size enhancement due to particle clustering, aggregation or the like.

Increasing carrier fluid viscosity in a Newtonian fluid also proportionally increases the resistance of the carrier fluid motion. In some embodiments, the fluid carrier has a lower limit of apparent dynamic viscosity, determined at 170 $s^{-1}$ and 25° C., of at least about 0.1 mPa-s, or at least about 1 mPa-s, or at least about 10 mPa-s, or at least about 25 mPa-s, or at least about 50 mPa-s, or at least about 75 mPa-s, or at least about 100 mPa-s, or at least about 150 mPa-s. A disadvantage of increasing the viscosity is that as the viscosity increases, the friction pressure for pumping the slurry generally increases as well. In some embodiments, the fluid carrier has an upper limit of apparent dynamic viscosity, determined at 170 $s^{-1}$ and 25° C., of less than about 300 mPa-s, or less than about 150 mPa-s, or less than about 100 mPa-s, or less than about 75 mPa-s, or less than about 50 mPa-s, or less than about 25 mPa-s, or less than about 10 mPa-s. In embodiments, the fluid phase viscosity ranges from any lower limit to any higher upper limit.

In some embodiments, an agent may both viscosify and impart yield stress characteristics, and in further embodiments may also function as a friction reducer to reduce friction pressure losses in pumping the treatment fluid. In embodiments, the liquid phase is essentially free of viscosifier or comprises a viscosifier in an amount ranging from 0.01 up to 2.4 g/L (0.08-20 lb/1000 gals) of the fluid phase. The viscosifier can be a viscoelastic surfactant (VES) or a hydratable gelling agent such as a polysaccharide, which may be crosslinked. When using viscosifiers and/or yield stress fluids, it may be useful to consider the need for and if necessary implement a clean-up procedure, i.e., removal or inactivation of the viscosifier and/or yield stress fluid during or following the treatment procedure, since fluids with viscosifiers and/or yield stresses may present clean up difficulties in some situations or if not used correctly. In certain embodiments, clean up can be effected using a breaker(s). In some embodiments, the slurry is stabilized for storage and/or pumping or other use at the surface conditions, and clean-up is achieved downhole at a later time and at a higher temperature, e.g., for some formations, the temperature difference between surface and downhole can be significant and useful for triggering degradation of the viscosifier, the particles, a yield stress agent or characteristic, and/or a breaker. Thus in some embodiments, breakers that are either temperature sensitive or time sensitive, either through delayed action breakers or delay in mixing the breaker into the slurry, can be useful.

In certain embodiments, the fluid may be stabilized by introducing colloidal particles into the treatment fluid, such as, for example, colloidal silica, which may function as a gellant and/or thickener.

In addition or as an alternative to increasing the viscosity of the carrier fluid (with or without density manipulation), increasing the volume fraction of the particles in the treatment fluid can also hinder movement of the carrier fluid. Where the particles are not deformable, the particles interfere with the flow of the fluid around the settling particle to cause hindered settling. The addition of a large volume fraction of particles can be complicated, however, by increasing fluid viscosity and pumping pressure, and increasing the risk of loss of fluidity of the slurry in the event of carrier fluid losses. In some embodiments, the treatment fluid has a lower limit of apparent dynamic viscosity, determined at 170 $s^{-1}$ and 25° C., of at least about 1 mPa-s, or at least about 10 mPa-s, or at least about 25 mPa-s, or at least about 50 mPa-s, or at least about 75 mPa-s, or at least about 100 mPa-s, or at least about 150 mPa-s, or at least about 300 mPa-s, and an upper limit of apparent dynamic viscosity, determined at 170 $s^{-1}$ and 25° C., of less than about 500 mPa-s, or less than about 300 mPa-s, or less than about 150 mPa-s, or less than about 100 mPa-s, or less than about 75 mPa-s, or less than about 50 mPa-s, or less than about 25 mPa-s, or less than about 10 mPa-s. In embodiments, the treatment fluid viscosity ranges from any lower limit to any higher upper limit.

In embodiments, the treatment fluid may be stabilized by introducing sufficient particles into the treatment fluid to increase the SVF of the treatment fluid, e.g., to at least 0.5. In a powder or particulated medium, the packed volume fraction (PVF) is defined as the volume of space occupied by the particles (the absolute volume) divided by the bulk volume, i.e., the total volume of the particles plus the void space between them:

$$PVF=\text{Particle volume}/(\text{Particle volume}+\text{Non-particle Volume})=1-\phi$$

For the purposes of calculating PVF and slurry solids volume fraction (SVF) herein, the particle volume includes the volume of any colloidal and/or submicron particles.

Here, the porosity, $\phi$, is the void fraction of the powder pack. Unless otherwise specified the PVF of a particulated medium is determined in the absence of overburden or other compressive force that would deform the packed solids. The packing of particles (in the absence of overburden) is a purely geometrical phenomenon. Therefore, the PVF depends only on the size and the shape of particles. The most ordered arrangement of monodisperse spheres (spheres with exactly the same size in a compact hexagonal packing) has a PVF of 0.74. However, such highly ordered arrangements of particles rarely occur in industrial operations. Rather, a somewhat random packing of particles is prevalent in oil-field treatment. Unless otherwise specified, particle packing in the current application means random packing of the particles. A random packing of the same spheres has a PVF of 0.64. In other words, the randomly packed particles occupy 64% of the bulk volume, and the void space occupies 36% of the bulk volume. A higher PVF can be achieved by preparing blends of particles that have more than one particle size and/or a range(s) of particle sizes. The smaller particles can fit in the void spaces between the larger ones.

The PVF in embodiments can therefore be increased by using a multimodal particle mixture, for example, coarse, medium and fine particles in specific volume ratios, where the fine particles can fit in the void spaces between the medium-size particles, and the medium size particles can fit in the void space between the coarse particles. For some embodiments of two consecutive size classes or modes, the ratio between the mean particle diameters ($d_{50}$) of each mode may be between 7 and 10. In such cases, the PVF can increase up to 0.95 in some embodiments. By blending coarse particles (such as proppant) with other particles selected to increase the PVF, only a minimum amount of fluid phase (such as water) is needed to render the treatment fluid pumpable. Such concentrated suspensions (i.e. slurry) tend to behave as a porous solid and may shrink under the force of gravity. This is a hindered settling phenomenon as discussed above and, as mentioned, the extent of solids-like behavior generally increases with the slurry solid volume fraction (SVF), which is given as $$SVF=\text{Particle volume}/(\text{Particle volume}+\text{Liquid volume})$$

It follows that proppant or other large particle mode settling in multimodal embodiments can if desired be minimized independently of the viscosity of the continuous phase. Therefore, in some embodiments little or no viscosifier and/or yield stress agent, e.g., a gelling agent, is required to inhibit settling and achieve particle transport, such as, for example, less than 2.4 g/L, less than 1.2 g/L, less than 0.6 g/L, less than 0.3 g/L, less than 0.15 g/L, less than 0.08 g/L, less than 0.04 g/L, less than 0.2 g/L or less than 0.1 g/L of viscosifier may be present in the STS.

It is helpful for an understanding of the current application to consider the amounts of particles present in the slurries of various embodiments of the treatment fluid. The minimum amount of fluid phase necessary to make a homogeneous slurry blend is the amount required to just fill all the void space in the PVF with the continuous phase, i.e., when SVF=PVF. However, this blend may not be flowable since all the solids and liquid may be locked in place with no room for slipping and mobility. In flowable system embodiments, SVF may be lower than PVF, e.g., SVF/PVF≤0.99. In this condition, in a stabilized treatment slurry, essentially all the voids are filled with excess liquid to increase the spacing between particles so that the particles can roll or flow past each other. In some embodiments, the higher the PVF, the lower the SVF/PVF ratio should be to obtain a flowable slurry.

FIG. 1 shows a slurry state progression chart for a system 600 having a particle mix with added fluid phase. The first fluid 602 does not have enough liquid added to fill the pore spaces of the particles, or in other words the SVF/PVF is greater than 1.0. The first fluid 602 is not flowable. The second fluid 604 has just enough fluid phase to fill the pore spaces of the particles, or in other words the SVF/PVF is equal to 1.0. Testing determines whether the second fluid 604 is flowable and/or pumpable, but a fluid with an SVF/PVF of 1.0 is generally not flowable or barely flowable due to an excessive apparent viscosity and/or yield stress. The third fluid 606 has slightly more fluid phase than is required to fill the pore spaces of the particles, or in other words the SVF/PVF is just less than 1.0. A range of SVF/PVF values less than 1.0 will generally be flowable and/or pumpable or mixable, and if it does not contain too much fluid phase (and/or contains an added viscosifier) the third fluid 606 is stable. The values of the range of SVF/PVF values that are pumpable, flowable, mixable, and/or stable are dependent upon, without limitation, the specific particle mixture, fluid phase viscosity, the PVF of the particles, and the density of the particles. Simple laboratory testing of the sort ordinarily performed for fluids before fracturing treatments can readily determine the stability (e.g., the STS stability test as described herein) and flowability (e.g., apparent dynamic viscosity at 170 $s^{-1}$ and 25° C. of less than about 10,000 mPa-s).

The fourth fluid 608 shown in FIG. 1 has more fluid phase than the third fluid 606, to the point where the fourth fluid 608 is flowable but is not stabilized and settles, forming a layer of free fluid phase at the top (or bottom, depending upon the densities of the particles in the fourth fluid 608). The amount of free fluid phase and the settling time over which the free fluid phase develops before the fluid is considered unstable are parameters that depend upon the specific circumstances of a treatment, as noted above. For example, if the settling time over which the free liquid develops is greater than a planned treatment time, then in one example the fluid would be considered stable. Other factors, without limitation, that may affect whether a particular fluid remains stable include the amount of time for settling and flow regimes (e.g. laminar, turbulent, Reynolds number ranges, etc.) of the fluid flowing in a flow passage of interest or in an agitated vessel, e.g., the amount of time and flow regimes of the fluid flowing in the wellbore, fracture, etc., and/or the amount of fluid leakoff occurring in the wellbore, fracture, etc. A fluid that is stable for one fracturing treatment may be unstable for a second fracturing treatment. The determination that a fluid is stable at particular conditions may be an iterative determination based upon initial estimates and subsequent modeling results. In some embodiments, the stabilized treatment fluid passes the STS test described herein.

Figure 2:
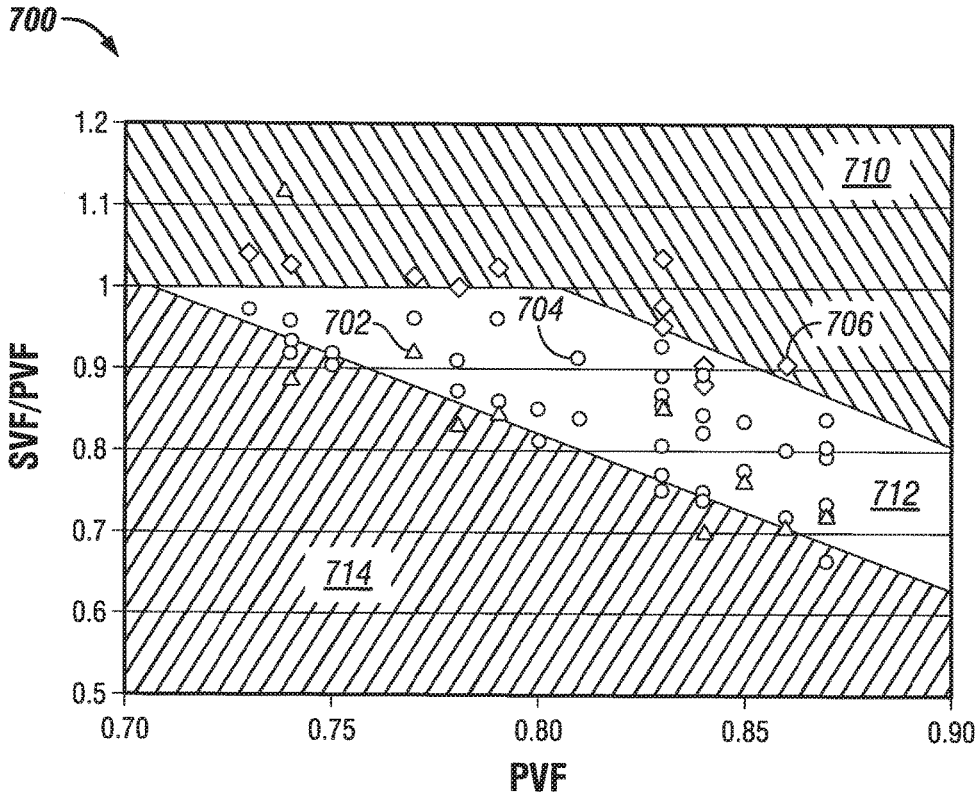
FIG. 2 illustrates fluid stability regions for a treatment fluid according to some embodiments of the current application.

FIG. 2 shows a data set 700 of various essentially Newtonian fluids without any added viscosifiers and without any yield stress, which were tested for the progression of slurry state on a plot of SVF/PVF as a function of PVF. The fluid phase in the experiments was water and the solids had specific gravity 2.6 g/mL. Data points 702 indicated with a triangle were values that had free water in the slurry, data points 704 indicated with a circle were slurriable fluids that were mixable without excessive free water, and data points 706 indicated with a diamond were not easily mixable liquid-solid mixtures. The data set 700 includes fluids prepared having a number of discrete PVF values, with liquid added until the mixture transitions from not mixable to a slurriable fluid, and then further progresses to a fluid having excess settling. At an example for a solids mixture with a PVF value near PVF=0.83, it was observed that around an SVF/PVF value of 0.95 the fluid transitions from an unmixable mixture to a slurriable fluid. At around an SVF/PVF of 0.7, the fluid transitions from a stable slurry to an unstable fluid having excessive settling. It can be seen from the data set 700 that the compositions can be defined approximately into a non-mixable region 710, a slurriable region 712, and a settling region 714.

FIG. 2 shows the useful range of SVF and PVF for slurries in embodiments without gelling agents. In some embodiments, the SVF is less than the PVF, or the ratio SVF/PVF is within the range from about 0.6 or about 0.65 to about 0.95 or about 0.98. Where the liquid phase has a viscosity less than 10 mPa-s or where the treatment fluid is water essentially free of thickeners, in some embodiments PVF is greater than 0.72 and a ratio of SVF/PVF is greater than about 1−2.1*(PVF−0.72) for stability (non-settling). Where the PVF is greater than 0.81, in some embodiments a ratio of SVF/PVF may be less than 1−2.1*(PVF−0.81) for mixability (flowability). Adding thickening or suspending agents, or solids that perform this function such as calcium carbonate or colloids, i.e., to increase viscosity and/or impart a yield stress, in some embodiments allows fluids otherwise in the settling area 714 embodiments (where SVF/PVF is less than or equal to about 1−2.1*(PVF−0.72)) to also be useful as an STS or in applications where a non-settling, slurriable/mixable slurry is beneficial, e.g., where the treatment fluid has a viscosity greater than 10 mPa-s, greater than 25 mPa-s, greater than 50 mPa-s, greater than 75 mPa-s, greater than 100 mPa-s, greater than 150 mPa-s, or greater than 300 mPa-s; and/or a yield stress greater than 0.1 Pa, greater than 0.5 Pa, greater than 1 Pa, greater than 10 Pa or greater than 20 Pa.

Introducing high-aspect ratio particles into the treatment fluid, e.g., particles having an aspect ratio of at least 6, represents additional or alternative embodiments for stabilizing the treatment fluid. Examples of such non-spherical particles include, but are not limited to, fibers, flakes, discs, rods, stars, etc., as described in, for example, U.S. Pat. No. 7,275,596, US20080196896, which are hereby incorporated herein by reference. In certain embodiments, introducing ciliated or coated proppant into the treatment fluid may stabilize or help stabilize the treatment fluid.

Proppant or other particles coated with a hydrophilic polymer can make the particles behave like larger particles and/or more tacky particles in an aqueous medium. The hydrophilic coating on a molecular scale may resemble ciliates, i.e., proppant particles to which hairlike projections have been attached to or formed on the surfaces thereof. Herein, hydrophilically coated proppant particles are referred to as "ciliated or coated proppant." Hydrophilically coated proppants and methods of producing them are described, for example, in WO 2011-050046, U.S. Pat. No. 5,905,468, U.S. Pat. No. 8,227,026 and U.S. Pat. No. 8,234,072, which are hereby incorporated herein by reference.

In some additional or alternative embodiment, the STS system may have the benefit that the smaller particles in the voids of the larger particles act as slip additives like mini-ball bearings, allowing the particles to roll past each other without any requirement for relatively large spaces between particles. This property can be demonstrated in some embodiments by the flow of the STS through a relatively small slot orifice with respect to the maximum diameter of the largest particle mode of the STS, e.g., a slot orifice less than 6 times the largest particle diameter, without bridging at the slot, i.e., the slurry flowed out of the slot has an SVF that is at least 90% of the SVF of the STS supplied to the slot. In contrast, the slickwater technique requires a ratio of perforation diameter to proppant diameter of at least 6, and additional enlargement for added safety to avoid screen out usually dictates a ratio of at least 8 or 10 and does not allow high proppant loadings.

In embodiments, the flowability of the STS through narrow flow passages such as perforations and fractures is similarly facilitated, allowing a smaller ratio of perforation diameter and/or fracture height to proppant size that still provides transport of the proppant through the perforation and/or to the tip of the fracture, i.e., improved flowability of the proppant in the fracture, e.g., in relatively narrow fracture widths, and improved penetration of the proppant-filled fracture extending away from the wellbore into the formation. These embodiments provide a relatively longer proppant-filled fracture prior to screenout relative to slickwater or high-viscosity fluid treatments.

As used herein, the "minimum slot flow test ratio" refers to a test wherein an approximately 100 mL slurry specimen is loaded into a fluid loss cell with a bottom slot opened to allow the test slurry to come out, with the fluid pushed by a piston using water or another hydraulic fluid supplied with an ISCO pump or equivalent at a rate of 20 mL/min, wherein a slot at the bottom of the cell can be adjusted to different openings at a ratio of slot width to largest particle mode diameter less than 6, and wherein the maximum slot flow test ratio is taken as the lowest ratio observed at which 50 vol % or more of the slurry specimen flows through the slot before bridging and a pressure increase to the maximum gauge pressure occurs. In some embodiments, the STS has a minimum slot flow test ratio less than 6, or less than 5, or less than 4, or less than 3, or a range of 2 to 6, or a range of 3 to 5.

Because of the relatively low water content (high SVF) of some embodiments of the STS, fluid loss from the STS may be a concern where flowability is important and SVF should at least be held lower than PVF, or considerably lower than PVF in some other embodiments. In conventional hydraulic fracturing treatments, there are two main reasons that a high volume of fluid and high amount of pumping energy have to be used, namely proppant transport and fluid loss. To carry the proppant to a distant location in a fracture, the treatment fluid has to be sufficiently turbulent (slickwater) or viscous (gelled fluid). Even so, only a low concentration of proppant is typically included in the treatment fluid to avoid settling and/or screen out. Moreover, when a fluid is pumped into a formation to initiate or propagate a fracture, the fluid pressure will be higher than the formation pressure, and the liquid in the treatment fluid is constantly leaking off into the formation. This is especially the case for slickwater operations. The fracture creation is a balance between the fluid loss and new volume created. As used herein, "fracture creation" encompasses either or both the initiation of fractures and the propagation or growth thereof. If the liquid injection rate is lower than the fluid loss rate, the fracture cannot be grown and becomes packed off. Therefore, traditional hydraulic fracturing operations are not efficient in creating fractures in the formation.

In some embodiments of the STS herein where the SVF is high, even a small loss of carrier fluid may result in a loss of flowability of the treatment fluid, and in some embodiments it is therefore undertaken to guard against excessive fluid loss from the treatment fluid, at least until the fluid and/or proppant reaches its ultimate destination. In embodiments, the STS may have an excellent tendency to retain fluid and thereby maintain flowability, i.e., it has a low leakoff rate into a porous or permeable surface with which it may be in contact. According to some embodiments of the current application, the treatment fluid is formulated to have very good leakoff control characteristics, i.e., fluid retention to maintain flowability. The good leak control can be achieved by including a leakoff control system in the treatment fluid of the current application, which may comprise one or more of high viscosity, low viscosity, a fluid loss control agent, selective construction of a multi-modal particle system in a multimodal fluid (MMF) or in a stabilized multimodal fluid (SMMF), or the like, or any combination thereof.

Figure 3:
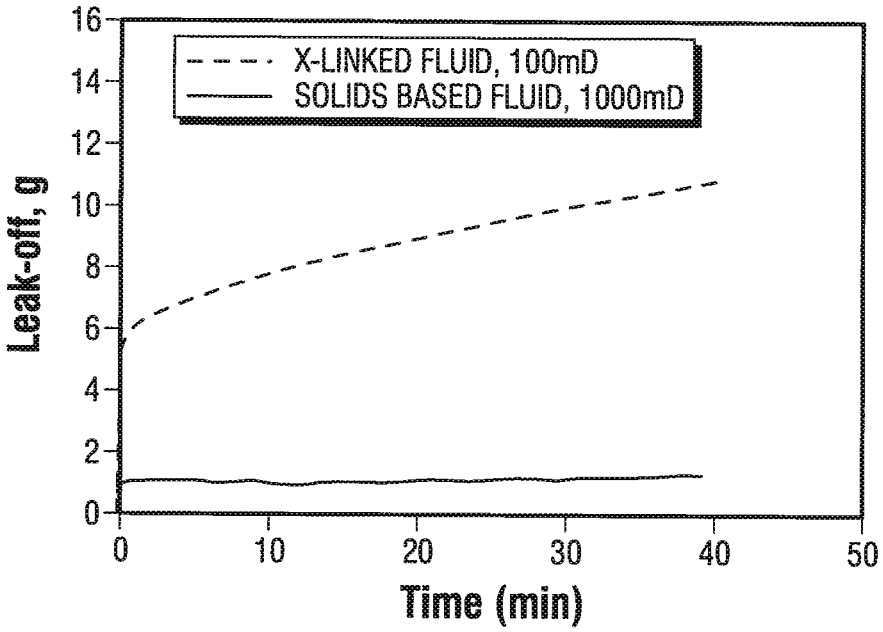
FIG. 3 shows the leakoff property of a low viscosity, stabilized treatment slurry (STS) (lower line) according to some embodiments of the current application compared to conventional crosslinked fluid (upper line).

As discussed in the examples below and as shown in FIG. 3, the leakoff of embodiments of a treatment fluid of the current application was an order of magnitude less than that of a conventional crosslinked fluid. It should be noted that the leakoff characteristic of a treatment fluid is dependent on the permeability of the formation to be treated. Therefore, a treatment fluid that forms a low permeability filter cake with good leakoff characteristic for one formation may or may not be a treatment fluid with good leakoff for another formation. Conversely, certain embodiments of the treatment fluids of the current application form low permeability filter cakes that have substantially superior leakoff characteristics such that they are not dependent on the substrate permeability provided the substrate permeability is higher than a certain minimum, e.g., at least 1 mD.

In certain embodiments herein, the STS comprises a packed volume fraction (PVF) greater than a slurry solids volume fraction (SVF), and has a spurt loss value (Vspurt) less than 10 vol % of a fluid phase of the stabilized treatment fluid or less than 50 vol % of an excess fluid phase (Vspurt<0.50*(PVF−SVF), where the "excess fluid phase" is taken as the amount of fluid in excess of the amount present at the condition SVF=PVF, i.e., excess fluid phase=PVF−SVF).

In some embodiments the treatment fluid comprises an STS also having a very low leakoff rate. For example, the total leakoff coefficient may be about $3\times10^{-4}$ m/min$^{1/2}$ ($10^{-3}$ ft/min$^{1/2}$) or less, or about $3\times10^{-5}$ ft/min$^{1/2}$ ($10^{-4}$ ft/min$^{1/2}$) or less. As used herein, Vspurt and the total leak-off coefficient Cw are determined by following the static fluid loss test and procedures set forth in Section 8-8.1, "Fluid loss under static conditions," in *Reservoir Stimulation,* 3$^{rd}$ Edition, Schlumberger, John Wiley & Sons, Ltd., pp. 8-23 to 8-24, 2000, in a filter-press cell using ceramic disks (FANN filter disks, part number 210538) saturated with 2% KCl solution and covered with filter paper and test conditions of ambient temperature (25° C.), a differential pressure of 3.45 MPa (500 psi), 100 ml sample loading, and a loss collection period of 60 minutes, or an equivalent testing procedure. In some embodiments of the current application, the treatment fluid has a fluid loss value of less than 10 g in 30 min when tested on a core sample with 1000 mD porosity. In some embodiments of the current application, the treatment fluid has a fluid loss value of less than 8 g in 30 min when tested on a core sample with 1000 mD porosity. In some embodiments of the current application, the treatment fluid has a fluid loss value of less than 6 g in 30 min when tested on a core sample with 1000 mD porosity. In some embodiments of the current application, the treatment fluid has a fluid loss value of less than 2 g in 30 min when tested on a core sample with 1000 mD porosity.

The unique low to no fluid loss property allows the treatment fluid to be pumped at a low rate or pumping stopped (static) with a low risk of screen out. In embodiments, the low fluid loss characteristic may be obtained by including a leak-off control agent, such as, for example, particulated loss control agents (in some embodiments less than 1 micron or 0.05-0.5 microns), graded PSD or multimodal particles, polymers, latex, fiber, etc. As used herein, the terms leak-off control agent, fluid loss control agent and similar refer to additives that inhibit fluid loss from the slurry into a permeable formation.

As representative leakoff control agents, which may be used alone or in a multimodal fluid, there may be mentioned latex dispersions, water soluble polymers, submicron particulates, particulates with an aspect ratio higher than 1, or higher than 6, combinations thereof and the like, such as, for example, crosslinked polyvinyl alcohol microgel. The fluid loss agent can be, for example, a latex dispersion of polyvinylidene chloride, polyvinyl acetate, polystyrene-co-butadiene; a water soluble polymer such as hydroxyethylcellulose (HEC), guar, copolymers of polyacrylamide and their derivatives; particulate fluid loss control agents in the size range of 30 nm to 1 micron, such as γ-alumina, colloidal silica, $CaCO_3$, $SiO_2$, bentonite etc.; particulates with different shapes such as glass fibers, flakes, films; and any combination thereof or the like. Fluid loss agents can if desired also include or be used in combination with acrylamido-methyl-propane sulfonate polymer (AMPS). In embodiments, the leak-off control agent comprises a reactive solid, e.g., a hydrolysable material such as PGA, PLA or the like; or it can include a soluble or solubilizable material such as a wax, an oil-soluble resin, or another material soluble in hydrocarbons, or calcium carbonate or another material soluble at low pH; and so on. In embodiments, the leak-off control agent comprises a reactive solid selected from ground quartz, oil soluble resin, degradable rock salt, clay, zeolite or the like. In other embodiments, the leak-off control agent comprises one or more of magnesium hydroxide, magnesium carbonate, magnesium calcium carbonate, calcium carbonate, aluminum hydroxide, calcium oxalate, calcium phosphate, aluminum metaphosphate, sodium zinc potassium polyphosphate glass, and sodium calcium magnesium polyphosphate glass, or the like.

The treatment fluid may additionally or alternatively include, without limitation, friction reducers, clay stabilizers, biocides, crosslinkers, breakers, corrosion inhibitors, and/or proppant flowback control additives. The treatment fluid may further include a product formed from degradation, hydrolysis, hydration, chemical reaction, or other process that occur during preparation or operation.

In certain embodiments herein, the STS may be prepared by combining the particles, such as proppant if present and subproppant, the carrier liquid and any additives to form a proppant-containing treatment fluid; and stabilizing the proppant-containing treatment fluid. The combination and stabilization may occur in any order or concurrently in single or multiple stages in a batch, semi-batch or continuous operation. For example, in some embodiments, the base fluid may be prepared from the subproppant particles, the carrier liquid and other additives, and then the base fluid combined with the proppant.

The treatment fluid may be prepared on location, e.g., at the wellsite when and as needed using conventional treatment fluid blending equipment.

Figure 4:
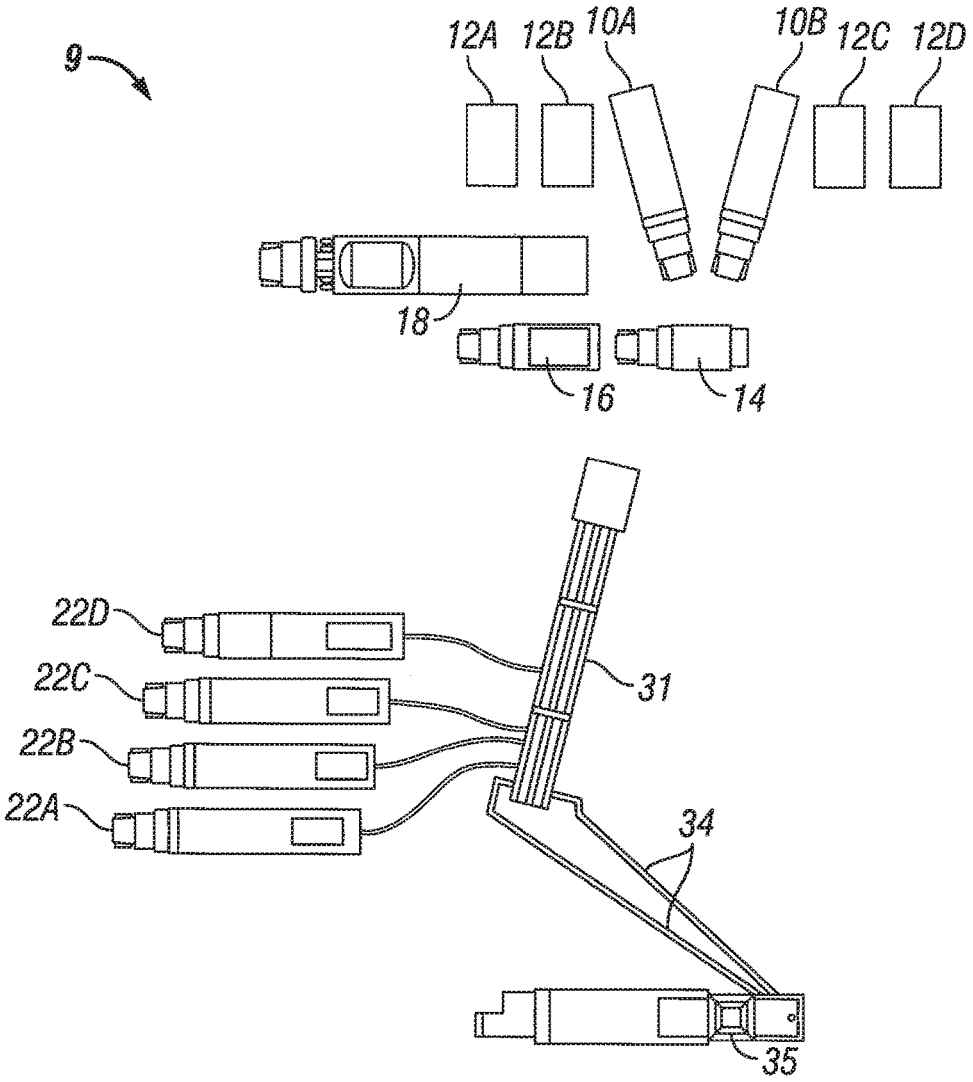
FIG. 4 shows a schematic representation of the wellsite equipment configuration with onsite mixing of an STS according to some embodiments of the current application.

FIG. 4 shows a wellsite equipment configuration 9 for a fracture treatment job according to some embodiments using the principles disclosed herein, for a land-based fracturing operation. The proppant is contained in sand trailers 10A, 10B. Water tanks 12A, 12B, 12C, 12D are arranged along one side of the operation site. Hopper 14 receives sand from the sand trailers 10A, 10B and distributes it into the mixer truck 16. Blender 18 is provided to blend the carrier medium (such as brine, viscosified fluids, etc.) with the proppant, i.e., "on the fly," and then the slurry is discharged to manifold 31. The final mixed and blended slurry, also called frac fluid, is then transferred to the pump trucks 22A, 22B, 22C, 22D, and routed at treatment pressure through treating line 34 to rig 35, and then pumped downhole. This configuration eliminates the additional mixer truck(s), pump trucks, blender(s), manifold(s) and line(s) normally required for slickwater fracturing operations, and the overall footprint is considerably reduced.

Figure 5:
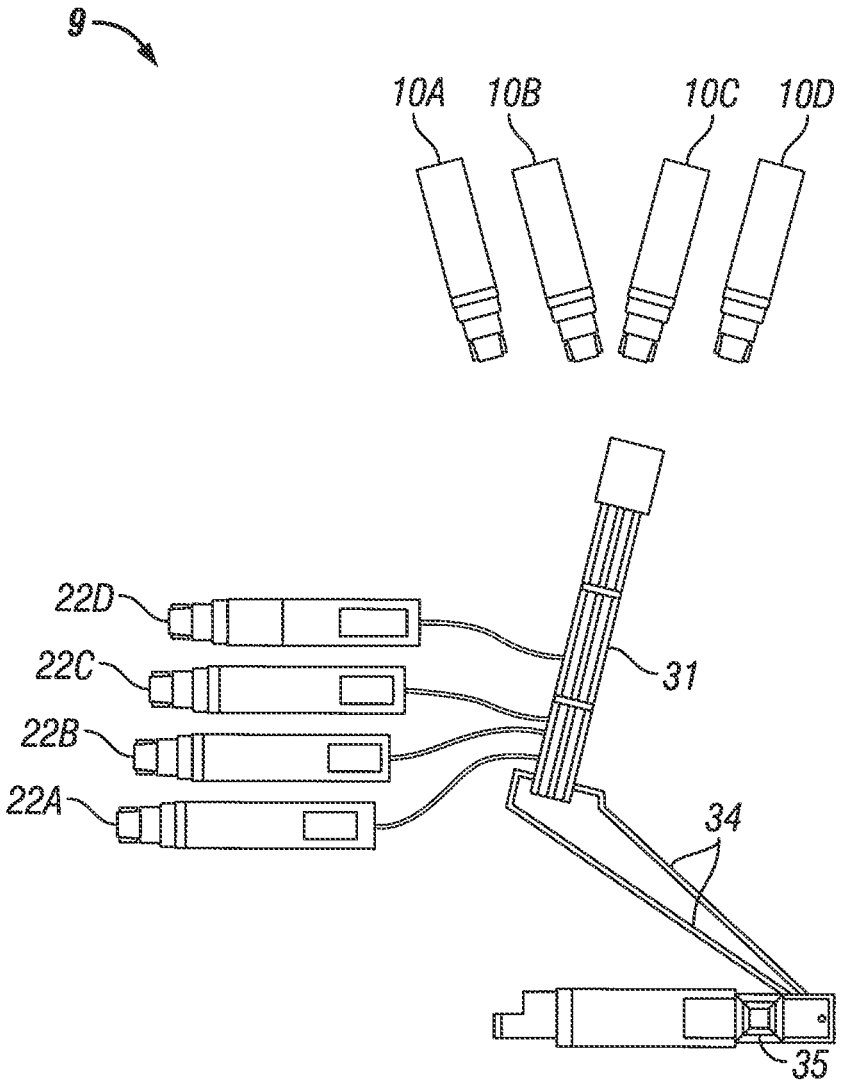
FIG. 5 shows a schematic representation of the wellsite equipment configuration with a pump-ready STS according to some embodiments of the current

FIG. 5 shows further embodiments of the wellsite equipment configuration with the additional feature of delivery of pump-ready treatment fluid delivered to the wellsite in trailers 10A to 10D and further elimination of the mixer 26, hopper 14, and/or blender 18. In some embodiments the treatment fluid is prepared offsite and pre-mixed with proppant and other additives, or with some or all of the additives except proppant, such as in a system described in co-pending co-assigned patent applications with application Ser. No. 13/415,025, filed on Mar. 8, 2012, and application Ser. No. 13/487,002, filed on Jun. 1, 2012, the entire contents of which are incorporated herein by reference in their entireties. As used herein, the term "pump-ready" should be understood broadly. In certain embodiments, a pump-ready treatment fluid means the treatment fluid is fully prepared and can be pumped downhole without being further processed. In some other embodiments, the pump-ready treatment fluid means the fluid is substantially ready to be pumped downhole except that a further dilution may be needed before pumping or one or more minor additives need to be added before the fluid is pumped downhole. In such an event, the pump-ready treatment fluid may also be called a pump-ready treatment fluid precursor. In some further embodiments, the pump-ready treatment fluid may be a fluid that is substantially ready to be pumped downhole except that certain incidental procedures are applied to the treatment fluid before pumping, such as low-speed agitation, heating or cooling under exceptionally cold or hot climate, etc.

In certain embodiments herein, for example in gravel packing, fracturing and frac-and-pack operations, the STS comprises proppant and a fluid phase at a volumetric ratio of the fluid phase (Vfluid) to the proppant (Vprop) equal to or less than 3. In embodiments, Vfluid/Vprop is equal to or less than 2.5. In embodiments, Vfluid/Vprop is equal to or less than 2. In embodiments, Vfluid/Vprop is equal to or less than 1.5. In embodiments, Vfluid/Vprop is equal to or less than 1.25. In embodiments, Vfluid/Vprop is equal to or less than 1. In embodiments, Vfluid/Vprop is equal to or less than 0.75. In embodiments, Vfluid/Vprop is equal to or less than 0.7. In embodiments, Vfluid/Vprop is equal to or less than 0.6. In embodiments, Vfluid/Vprop is equal to or less than 0.5. In embodiments, Vfluid/Vprop is equal to or less than 0.4. In embodiments, Vfluid/Vprop is equal to or less than 0.35. In embodiments, Vfluid/Vprop is equal to or less than 0.3. In embodiments, Vfluid/Vprop is equal to or less than 0.25. In embodiments, Vfluid/Vprop is equal to or less than 0.2. In embodiments, Vfluid/Vprop is equal to or less than 0.1. In embodiments, Vfluid/Vprop may be sufficiently high such that the STS is flowable. In some embodiments, the ratio $V_{fluid}/V_{prop}$ is equal to or greater than 0.05, equal to or greater than 0.1, equal to or greater than 0.15, equal to or greater than 0.2, equal to or greater than 0.25, equal to or greater than 0.3, equal to or greater than 0.35, equal to or greater than 0.4, equal to or greater than 0.5, or equal to or greater than 0.6, or within a range from any lower limit to any higher upper limit mentioned above.

Nota bene, the STS may optionally comprise subproppant particles in the whole fluid which are not reflected in the Vfluid/Vprop ratio, which is merely a ratio of the liquid phase (sans solids) volume to the proppant volume. This ratio is useful, in the context of the STS where the liquid phase is aqueous, as the ratio of water to proppant, i.e., Vwater/Vprop. In contrast, the "ppa" designation refers to pounds proppant added per gallon of base fluid (liquid plus subproppant particles), which can be converted to an equivalent volume of proppant added per volume of base fluid if the specific gravity of the proppant is known, e.g., 2.65 in the case of quartz sand embodiments, in which case 1 ppa=0.12 kg/L=45 mL/L; whereas "ppg" (pounds of proppant per gallon of treatment fluid) and "ppt" (pounds of additive per thousand gallons of treatment fluid) are based on the volume of the treatment fluid (liquid plus proppant and subproppant particles), which for quartz sand embodiments (specific gravity=2.65) also convert to 1 ppg=1000 ppt=0.12 kg/L=45 mL/L. The ppa, ppg and ppt nomenclature and their metric or SI equivalents are useful for considering the weight ratios of proppant or other additive(s) to base fluid (water or other fluid and subproppant) and/or to treatment fluid (water or other fluid plus proppant plus subproppant). The ppt nomenclature is generally used in embodiments reference to the concentration by weight of low concentration additives other than proppant, e.g., 1 ppt=0.12 g/L.

In embodiments, the proppant-containing treatment fluid comprises 0.27 L or more of proppant volume per liter of treatment fluid (corresponding to 720 g/L (6 ppg) in embodiments where the proppant has a specific gravity of 2.65), or 0.36 L or more of proppant volume per liter of treatment fluid (corresponding to 960 g/L (8 ppg) in embodiments where the proppant has a specific gravity of 2.65), or 0.4 L or more of proppant volume per liter of treatment fluid (corresponding to 1.08 kg/L (9 ppg) in embodiments where the proppant has a specific gravity of 2.65), or 0.44 L or more of proppant volume per liter of treatment fluid (corresponding to 1.2 kg/L (10 ppg) in embodiments where the proppant has a specific gravity of 2.65), or 0.53 L or more of proppant volume per liter of treatment fluid (corresponding to 1.44 kg/L (12 ppg) in embodiments where the proppant has a specific gravity of 2.65), or 0.58 L or more of proppant volume per liter of treatment fluid (corresponding to 1.56 kg/L (13 ppg) in embodiments where the proppant has a specific gravity of 2.65), or 0.62 L or more of proppant volume per liter of treatment fluid (corresponding to 1.68 kg/L (14 ppg) in embodiments where the proppant has a specific gravity of 2.65), or 0.67 L or more of proppant volume per liter of treatment fluid (corresponding to 1.8 kg/L (15 ppg) in embodiments where the proppant has a specific gravity of 2.65), or 0.71 L or more of proppant volume per liter of treatment fluid (corresponding to 1.92 kg/L (16 ppg) in embodiments where the proppant has a specific gravity of 2.65).

As used herein, in some embodiments, "high proppant loading" means, on a mass basis, more than 1.0 kg proppant added per liter of whole fluid including any sub-proppant particles (8 ppa,), or on a volumetric basis, more than 0.36 L proppant added per liter of whole fluid including any sub-proppant particles, or a combination thereof. In some embodiments, the treatment fluid comprises more than 1.1 kg proppant added per liter of whole fluid including any sub-proppant particles (9 ppa), or more than 1.2 kg proppant added per liter of whole fluid including any sub-proppant particles (10 ppa), or more than 1.44 kg proppant added per liter of whole fluid including any sub-proppant particles (12 ppa), or more than 1.68 kg proppant added per liter of whole fluid including any sub-proppant particles (14 ppa), or more than 1.92 kg proppant added per liter of whole fluid including any sub-proppant particles (16 ppa), or more than 2.4 kg proppant added per liter of fluid including any sub-proppant particles (20 ppa), or more than 2.9 kg proppant added per liter of fluid including any sub-proppant particles (24 ppa). In some embodiments, the treatment fluid comprises more than 0.45 L proppant added per liter of whole fluid including any sub-proppant particles, or more than 0.54 L proppant added per liter of whole fluid including any sub-proppant particles, or more than 0.63 L proppant added per liter of whole fluid including any sub-proppant particles, or more than 0.72 L proppant added per liter of whole fluid including any sub-proppant particles, or more than 0.9 L proppant added per liter of whole fluid including any sub-proppant particles.

In some embodiments, the water content in the fracture treatment fluid formulation is low, e.g., less than 30% by volume of the treatment fluid, the low water content enables low overall water volume to be used, relative to a slickwater fracture job for example, to place a similar amount of proppant or other solids, with low to essentially zero fluid infiltration into the formation matrix and/or with low to zero flowback after the treatment, and less chance for fluid to enter the aquifers and other intervals. The low flowback leads to less delay in producing the stimulated formation, which can be placed into production with a shortened clean up stage or in some cases immediately without a separate flowback recovery operation.

In embodiments where the fracturing treatment fluid also has a low viscosity and a relatively high SVF, e.g., 40, 50, 60 or 70% or more, the fluid can in some surprising embodiments be very flowable (low viscosity) and can be pumped using standard well treatment equipment. With a high volumetric ratio of proppant to water, e.g., greater than about 1.0, these embodiments represent a breakthrough in water efficiency in fracture treatments. Embodiments of a low water content in the treatment fluid certainly results in correspondingly low fluid volumes to infiltrate the formation, and importantly, no or minimal flowback during fracture cleanup and when placed in production. In the solid pack, as well as on formation surfaces and in the formation matrix, water can be retained due to a capillary and/or surface wetting effect. In embodiments, the solids pack obtained from an STS with multimodal solids can retain a larger proportion of water than conventional proppant packs, further reducing the amount of water flowback. In some embodiments, the water retention capability of the fracture-formation system can match or exceed the amount of water injected into the formation, and there may thus be no or very little water flowback when the well is placed in production.

In some specific embodiments, the proppant laden treatment fluid comprises an excess of a low viscosity continuous fluid phase, e.g., a liquid phase, and a multimodal particle phase, e.g. solids phase, comprising high proppant loading with one or more proppant modes for fracture conductivity and at least one sub-proppant mode to facilitate proppant injection. As used herein an excess of the continuous fluid phase implies that the fluid volume fraction in a slurry (1-SVF) exceeds the void volume fraction (1-PVF) of the solids in the slurry, i.e., SVF<PVF. Solids in the slurry in embodiments may comprise both proppant and one or more sub-proppant particle modes. In embodiments, the continuous fluid phase is a liquid phase.

In some embodiments, the STS is prepared by combining the proppant and a fluid phase having a viscosity less than 300 mPa-s (170 $s^{-1}$, 25 C) to form the proppant-containing treatment fluid, and stabilizing the proppant-containing treatment fluid. Stabilizing the treatment fluid is described above. In some embodiments, the proppant-containing treatment fluid is prepared to comprise a viscosity between 0.1 and 300 mPa-s (170 $s^{-1}$, 25 C) and a yield stress between 1 and 20 Pa (2.1-42 $lb/ft^2$). In some embodiments, the proppant-containing treatment fluid comprises 0.36 L or more of proppant volume per liter of proppant-containing treatment fluid (8 ppa proppant equivalent where the proppant has a specific gravity of 2.6), a viscosity between 0.1 and 300 mPa-s (170 $s^{-1}$, 25 C), a solids phase having a packed volume fraction (PVF) greater than 0.72, a slurry solids volume fraction (SVF) less than the PVF and a ratio of SVF/PVF greater than about 1−2.1*(PVF−0.72).

In some embodiments, e.g., for delivery of a fracturing stage, the STS comprises a volumetric proppant/treatment fluid ratio (including proppant and sub-proppant solids) in a main stage of at least 0.27 L/L (6 ppg at sp.gr. 2.65), or at least 0.36 L/L (8 ppg), or at least 0.44 L/L (10 ppg), or at least 0.53 L/L (12 ppg), or at least 0.58 L/L (13 ppg), or at least 0.62 L/L (14 ppg), or at least 0.67 L/L (15 ppg), or at least 0.71 L/L (16 ppg).

In some embodiments, the hydraulic fracture treatment may comprise an overall volumetric proppant/water ratio of at least 0.13 L/L (3 ppg at sp. gr. 2.65), or at least 0.18 L/L (4 ppg), or at least 0.22 L/L (5 ppg), or at least 0.26 L/L (6 ppg), or at least 0.38 L/L (8 ppg), or at least 0.44 L/L (10 ppg), or at least 0.53 L/L (12 ppg), or at least 0.58 L/L (13 ppg). Note that subproppant particles are not a factor in the determination of the proppant water ratio.

In some embodiments, e.g., a front-end stage STS, the slurry comprises a stabilized solids mixture comprising a particulated leakoff control system (which may include solid and/or liquid particles, e.g., submicron particles, colloids, micelles, PLA dispersions, latex systems, etc.) and a solids volume fraction (SVF) of at least 0.4.

In some embodiments, e.g., a pad stage STS, the slurry comprises viscosifier in an amount to provide a viscosity in the pad stage of greater than 300 mPa-s, determined on a whole fluid basis at 170 $s^{-1}$ and 25° C.

In some embodiments, e.g., a flush stage STS, the slurry comprises a proppant-free slurry comprising a stabilized solids mixture comprising a particulated leakoff control system (which may include solid and/or liquid particles, e.g., submicron particles, colloids, micelles, PLA dispersions, latex systems, etc.) and a solids volume fraction (SVF) of at least 0.4. In other embodiments, the proppant-containing fracturing stage may be used with a flush stage comprising a first substage comprising viscosifier and a second substage comprising slickwater. The viscosifier may be selected from viscoelastic surfactant systems, hydratable gelling agents (optionally including crosslinked gelling agents), and the like. In other embodiments, the flush stage comprises an overflush equal to or less than 3200 L (20 42-gal bbls), equal to or less than 2400 L (15 bbls), or equal to or less than 1900 L (12 bbls).

In some embodiments, the proppant stage comprises a continuous single injection of the STS free of spacers.

In some embodiments the STS comprises a total proppant volume injected into the wellbore or to be injected into the wellbore of at least 800 liters. In some embodiments, the total proppant volume is at least 1600 liters. In some embodiments, the total proppant volume is at least 3200 liters. In some embodiments, the total proppant volume is at least 8000 liters. In some embodiments, the total proppant volume is at least 80,000 liters. In some embodiments, the total proppant volume is at least 800,000 liters. The total proppant volume injected into the wellbore or to be injected into the wellbore is typically not more than 16 million liters.

Sometimes it is desirable to stop pumping a treatment fluid during a hydraulic fracturing operation, such as for example, when an emergency shutdown is required. For example, there may be a complete failure of surface equipment, there may be a near wellbore screenout, or there may be a natural disaster due to weather, fire, earthquake, etc. However, with unstabilized fracturing fluids such as slickwater, the proppant suspension will be inadequate at zero pumping rate, and proppant may screen out in the wellbore and/or fail to get placed in the fracture. With slickwater it is usually impossible to resume the fracturing operation without first cleaning the settled proppant out of the wellbore, often using coiled tubing or a workover rig. There is some inefficiency in fluidizing proppant out of the wellbore with coiled tubing, and a significant amount of a specialized clean out fluid will be used to entrain the proppant and lift it to surface. After the clean out, a decision will need to be made whether to repeat the treatment or just leave that portion of the wellbore sub-optimally treated. In contrast, in embodiments herein, the treatment fluid is stabilized and the operator can decide to resume and/or complete the fracture operation, or to circulate the STS (and any proppant) out of the well bore. By stabilizing the treatment fluid to practically eliminate particle settling, the treatment fluid possesses the characteristics of excellent proppant conveyance and transport even when static.

Due to the stability of the treatment fluid in some embodiments herein, the proppant will remain suspended and the fluid will retain its fracturing properties during the time the pumping is interrupted. In some embodiments herein, a method comprises combining at least 0.36, at least 0.4, or at least 0.45 L of proppant per liter of base fluid to form a proppant-containing treatment fluid, stabilizing the proppant-containing treatment fluid, pumping the STS, e.g., injecting the proppant-containing treatment fluid into a subterranean formation and/or creating a fracture in the subterranean formation with the treatment fluid, stopping pumping of the STS thereby stranding the treatment fluid in the wellbore, and thereafter resuming pumping of the treatment fluid, e.g., to inject the stranded treatment fluid into the formation and continue the fracture creation, and/or to circulate the stranded treatment fluid out of the wellbore as an intact plug with a managed interface between the stranded treatment fluid and a displacing fluid. Circulating the treatment fluid out of the wellbore can be achieved optionally using coiled tubing or a workover rig, if desired, but in embodiments the treatment fluid will itself suspend and convey all the proppant out of the wellbore with high efficiency. In some embodiments, the method may include managing the interface between the treatment fluid and any displacing fluid, such as, for example, matching density and viscosity between the treatment and displacing fluids, using a wiper plug or pig, using a gelled pill or fiber pill or the like, to prevent density and viscous instabilities.

In some embodiments, the treatment provides production-related features resulting from a low water content in the treatment fluid, such as, for example, less infiltration into the formation and/or less water flowback. Formation damage occurs whenever the native reservoir conditions are disturbed. A significant source of formation damage during hydraulic fracturing occurs when the fracturing fluids contact and infiltrate the formation. Measures can be taken to reduce the potential for formation damage, including adding salts to improve the stability of fines and clays in the formation, addition of scale inhibitors to limit the precipitation of mineral scales caused by mixing of incompatible brines, addition of surfactants to minimize capillary blocking of the tight pores and so forth. There are some types of formation damage for which additives are not yet available to solve. For example, some formations will be mechanically weakened upon coming in contact with water, referred to herein as water-sensitive formations. Thus, it is desirable to significantly reduce the amount of water that can infiltrate the formation during a well completion operation.

Very low water slurries and water free slurries according to certain embodiments disclosed herein offer a pathway to significantly reduce water infiltration and the collateral formation damage that may occur. Low water STS minimizes water infiltration relative to slick water fracture treatments by two mechanisms. First, the water content in the STS can be less than about 40% of slickwater per volume of respective treatment fluid, and the STS can provide in some embodiments more than a 90% reduction in the amount of water used per volume or weight of proppant placed in the formation. Second, the solids pack in the STS in embodiments including subproppant particles retains more water than conventional proppant packs so that less water is released from the STS into the formation.

After fracturing, water flowback plagues the prior art fracturing operations. Load water recovery typically characterizes the initial phase of well start up following a completion operation. In the case of horizontal wells with massive hydraulic fractures in unconventional reservoirs, 15 to 30% of the injected hydraulic fracturing fluid is recovered during this start up phase. At some point, the load water recovery rate becomes very low and the produced gas rate high enough for the well to be directed to a gas pipeline to market. We refer to this period of time during load water recovery as the fracture clean up phase. It is normal for a well to clean up for several days before being connected to a gas sales pipeline. The flowback water must be treated and/or disposed of, and delays pipeline production. A low water content slurry according to embodiments herein can significantly reduce the volume and/or duration, or even eliminate this fracture clean up phase. Fracturing fluids normally are lost into the formation by various mechanisms including filtration into the matrix, imbibition into the matrix, wetting the freshly exposed new fracture face, loss into natural fractures. A low water content slurry will become dry with only a small loss of its water into the formation by these mechanisms, leaving in some embodiments no or very little free water to be required (or able) to flow back during the fracture clean up stage. The advantages of zero or reduced flowback include reduced operational cost to manage flowback fluid volumes, reduced water treatment cost, reduced time to put well to gas sales, reduction of problematic waste that will develop by injected waters solubilizing metals, naturally occurring radioactive materials, etc.

There have also been concerns expressed by the general public that hydraulic fracturing fluid may find some pathway into a potable aquifer and contaminate it. Although proper well engineering and completion design, and fracture treatment execution will prevent any such contamination from occurring, if it were to happen by an unforeseen accident, a slickwater system will have enough water and mobility in an aquifer to migrate similar to a salt water plume. A low water STS in embodiments may have a 90% reduction in available water per mass of proppant such that any contact with an aquifer, should it occur, will have much less impact than slickwater.

Subterranean formations are heterogeneous, with layers of high, medium, and low permeability strata interlaced. A hydraulic fracture that grows to the extent that it encounters a high permeability zone will suddenly experience a high leakoff area that will attract a disproportionately large fraction of the injected fluid significantly changing the geometry of the created hydraulic fracture possibly in an undesirable manner. A hydraulic fracturing fluid that would automatically plug a high leakoff zone is useful in that it would make the fracture execution phase more reliable and probably ensure the fracture geometry more closely resembles the designed geometry (and thus production will be closer to that expected). One feature of embodiments of an STS is that it will dehydrate and become an immobile mass (plug) upon losing more than 25% of the water it is formulated with. As an STS in embodiments only contains up to 50% water by volume, then it will only require a loss of a total of 12.5% of the STS treatment fluid volume in the high fluid loss affected area to become an immobile plug and prevent subsequent fluid loss from that area; or in other embodiments only contains up to 40% water by volume, requiring a loss of a total of 10% of the STS treatment fluid volume to become immobile. A slick water system would need to lose around 90% or 95% of its total volume to dehydrate the proppant into an immobile mass.

Sometimes, during a hydraulic fracture treatment, the surface treating pressure will approach the maximum pressure limit for safe operation. The maximum pressure limit may be due to the safe pressure limitation of the wellhead, the surface treating lines, the casing, or some combination of these items. One common response to reaching an upper pressure limit is to reduce the pumping rate. However, with ordinary fracturing fluids, the proppant suspension will be inadequate at low pumping rates, and proppant may fail to get placed in the fracture. The stabilized fluids in some embodiments of this disclosure, which can be highly stabilized and practically eliminate particle settling, possess the characteristic of excellent proppant conveyance and transport even when static. Thus, some risk of treatment failure is mitigated since a fracture treatment can be pumped to completion in some embodiments herein, even at very low pump rates should injection rate reduction be necessary to stay below the maximum safe operating pressure during a fracture treatment with the stabilized treatment fluid.

In some embodiments, the injection of the treatment fluid of the current application can be stopped all together (i.e. at an injection rate of 0 bbl/min). Due to the excellent stability of the treatment fluid, very little or no proppant settling occurs during the period of 0 bbl/min injection. Well intervention, treatment monitoring, equipment adjustment, etc. can be carried out by the operator during this period of time. The pumping can be resumed thereafter. Accordingly, in some embodiments of the current application, there is provided a method comprising injecting a proppant laden treatment fluid into a subterranean formation penetrated by a wellbore, initiating or propagating a fracture in the subterranean formation with the treatment fluid, stopping injecting the treatment fluid for a period of time, restarting injecting the treatment fluid to continue the initiating or propagating of the fracture in the subterranean formation.

In some embodiments, the treatment and system may achieve the ability to fracture using a carbon dioxide proppant stage treatment fluid. Carbon dioxide is normally too light and too thin (low viscosity) to carry proppant in a slurry useful in fracturing operations. However, in an STS fluid, carbon dioxide may be useful in the liquid phase, especially where the proppant stage treatment fluid also comprises a particulated fluid loss control agent. In embodiments, the liquid phase comprises at least 10 wt % carbon dioxide, at least 50 wt % carbon dioxide, at least 60 wt % carbon dioxide, at least 70 wt % carbon dioxide, at least 80 wt % carbon dioxide, at least 90 wt % carbon dioxide, or at least 95 wt % carbon dioxide. The carbon dioxide-containing liquid phase may alternatively or additionally be present in any pre-pad stage, pad stage, front-end stage, flush stage, post-flush stage, or any combination thereof.

Various jetting and jet cutting operations in embodiments are significantly improved by the non-settling and solids carrying abilities of the STS. Jet perforating and jet slotting are embodiments for the STS, wherein the proppant is replaced with an abrasive or erosive particle. Multi-zone fracturing systems using a locating sleeve/polished bore and jet cut opening are embodiments.

Drilling cuttings transport and cuttings stability during tripping are also improved in embodiments. The STS can act to either fracture the formation or bridge off cracks, depending on the exact mixture used. The STS can provide an extreme ability to limit fluid losses to the formation, a very significant advantage. Minimizing the amount of liquid will make oil based muds much more economically attractive.

The modification of producing formations using explosives and/or propellant devices in embodiments is improved by the ability of the STS to move after standing stationary and also by its density and stability.

Zonal isolations operations in embodiments are improved by specific STS formulations optimized for leakoff control and/or bridging abilities. Relatively small quantities of the STS radically improve the sealing ability of mechanical and inflatable packers by filling and bridging off gaps. Permanent isolation of zones is achieved in some embodiments by bullheading low permeability versions of the STS into water producing formations or other formations desired to be isolated. Isolation in some embodiments is improved by using a setting formulation of the STS, but non-setting formulations can provide very effective permanent isolation. Temporary isolation may be delivered in embodiments by using degradable materials to convert a non-permeable pack into a permeable pack after a period of time.

The pressure containing ability and ease of placement/removal of sand plugs in embodiments are significantly improved using appropriate STS formulations selected for high bridging capacity. Such formulations will allow much larger gaps between the sand packer tool and the well bore for the same pressure capability. Another major advantage is the reversibility of dehydration in some embodiments; a solid sand pack may be readily re-fluidized and circulated out, unlike conventional sand plugs.

In other embodiments, plug and abandon work may be improved using CRETE cementing formulations in the STS and also by placing bridging/leakoff controlling STS formulations below and/or above cement plugs to provide a seal repairing material. The ability of the STS to re-fluidize after long periods of immobilization facilitates this embodiment. CRETE cementing formulations are disclosed in U.S. Pat. No. 6,626,991, GB 2,277,927, U.S. Pat. No. 6,874,578, WO 2009/046980, Schlumberger CemCRETE Brochure (2003), and Schlumberger Cementing Services and Products—Materials, pp. 39-76 (2012), available at http://www.slb.com/~/media/Files/cementing/catalogs/05_cementing_materials.pdf which are hereby incorporated herein by reference, and are commercially available from Schlumberger.

This STS in other embodiments finds application in pipeline cleaning to remove methane hydrates due to its carrying capacity and its ability to resume motion.

As mentioned previously, at least a portion of the solid in the fracturation fluid comprises thermite. The thermite may be used as the only solid or may be present as fine, medium or large part of a multimodal fluid configuration. The shape of the thermite is a non-limiting feature; it may be granular, rods, fibers, plates, or any other suitable shape. In some embodiments, at least some of the particles contain one of the first metal and the oxide of the second metal; at least a portion of the thermite is a powder; and at least some of the granules comprise both components of the thermite. Other variations include a method in which the thermite further includes either at least one other metal alloyed with aluminum, or sulfur and optionally barium nitrate, or both.

In some embodiments, the multimodal blend comprises at least proppant and thermite, and the injection of solids including thermite is alternated with injection of solids not including thermite. In further embodiments, the slurry further comprises magnesium ribbons, these may improve the ignition.

Once placed downhole, the ignition of the thermite may be with a downhole tool, or by a high temperature chemical reaction, in this case the reactants of the chemical reaction may be introduced sequentially into the fracture. In these methods, the heat of the chemical reaction is used to initiate or catalyze the reaction of a solid in the fracture that is not a component of the thermite, for example a solid acid-precursor.

In some embodiments, prior to ignition of the thermite, the original wellbore is at least partially filled with a material that protects the wellhead from excess pressure or shocks. In further embodiments, the thermite-affected region is fluidly-connected to the surface by a method comprising redrilling at least a portion of the original wellbore; the thermite-affected region may be fluidly-connected to the surface by a method involving drilling a lateral or spur from the original wellbore; the thermite-affected region may fluidly-connected to the surface by a method involving drilling a second wellbore; and the thermite-affected region may be fluidly-connected to the surface by a method involving a second fracturing treatment.

In yet further embodiments, the thermite-affected region may be mapped with the use of micro seismic or tilt meter detection or both. The mapping may also be made using at least one isotopic elemental tracer; or using a tool that detects a property of or an emission from the formation, the fracture or a fluid; or with the use of a tool that emits and detects a form of radiation.

A further advantage of thermite is that it is difficult to ignite and so can be stored safely as a mixture and can be handled in conventional wellsite equipment. Although the reactants are stable at wellbore or subterranean formation temperatures, they burn with an extremely intense exothermic reaction when heated to the ignition temperature. The products are liquids due to the high temperatures reached (up to at least 2500° C. (4500° F.) with $Fe_2O_3$ as the oxide), although the actual temperature reached depends on the rate of heat escape. A further advantage is that thermite contains its own supply of oxygen and does not require any external source of air. Consequently, it cannot be smothered and may ignite in any environment, given sufficient initial heat. A further advantage is that it will burn well while wet and cannot be extinguished with water. Small amounts of water will boil before reaching the reaction. In large amounts of water, the molten second metal produced will extract oxygen from water and generate hydrogen gas. The thermite reaction is not itself an explosive event because it does not give off gasses, but materials present in subterranean formations, such as water and hydrocarbons, may boil or react explosively. Accordingly, it may be advantageous to add thermites to a fluid that has been foamed or energized. Foaming with a neutral gas may even further improve the handling of the thermite. STS energized fluid may be envisaged. Without wishing to be bound by any theory, it is believed that energizing the carrier fluid would be even more advantageous since the gases may expand when heated to the ultimate reaction temperature of the thermite. This would provide much more energy as the gases expand, resulting in the creation of numerous fractures initiating away from the principal hydraulic fracture and thus an improved yield of production. Any foamed or energized fluids may be envisaged. Stable foam fluids broadly comprise a liquid base, a gas and usually a surface active agent to create a stable foam having a Mitchell quality in the range of between 0.52 to 0.99 and preferably within the range of 0.60 to 0.85 at the temperature and pressure conditions existing during treatment of the formation encountered. Method for measuring Mitchell Quality of the foam may be found in U.S. Pat. No. 3,937,283 incorporated herein by reference. Energized fluid have typically a Mitchel quality below 0.52; they may be formed from various gas such as air, carbon dioxide, helium, argon, nitrogen, or hydrocarbon gases (such as methane, ethane, propane, butane, pentane, hexane, heptane . . . ), and mixtures thereof.

Thermite reactions require very high temperatures for initiation. These cannot be reached with conventional black-powder fuses, nitrocellulose rods, detonators, or other common igniting substances and devices. Even when thermite is red hot, it will not ignite; the reaction is initiated when the thermite is at or near white hot. The reaction between a strong oxidizer, for example potassium permanganate or calcium hypochlorite, and a suitable fuel, for example glycerine, benzaldehyde, or ethylene glycol, may be used to ignite thermite. When these two substances mix, a spontaneous reaction begins and slowly increases the temperature of the mixture. The heat released by the oxidation of glycerine is sufficient to initiate a thermite reaction. Alternating slugs of thermite and permanganate/glycerine (or similar) may be pumped, or the permanganate/glycerine may be put into the borehole, alternatively, the fuel or the oxidizing agent may be put first, after a fracture is filled with thermite. These, or similar, materials may be encapsulated or pumped using inert spacers to prevent premature initiation. In such situation the delay between mixing and ignition may be varied by modifying the particle size and ambient temperature. Initiation may also be brought about by shooting perforation guns, electric heating at one or more locations, detonation of one or more small high-explosive charges, one or more magnesium flares, or ignition of one or more non-explosive combustion charges (that include both a fuel and a self-contained oxygen source that is itself ignited by exploding an igniter and then burns in a self-sustained combustion reaction). High explosives or fuels may be incorporated in, and/or ignited by, conventional or modified perforating guns conveyed by wireline or tubing. Electrical ignition, or lighting of magnesium or fuel charges, may be effected by tools deployed by slickline. Ignition by laser conveyed downhole by an optical fiber may also be envisaged.

The thermite may also be ignited, for example, with a mixture that ignites more easily than thermite but burns hot enough to light the thermite reliably. A suitable mixture may be, for example, about 5 parts potassium nitrate, about 3 parts finely ground aluminum, and about 2 parts sulfur, mixed thoroughly. For example, about 2 parts of this mixture is combined with about 1 part of thermite. This may be placed as the last of the fracturing slurry or may be placed in the borehole after the fracturing.

The thermite may also be ignited, for example, with a device or apparatus that is capable of releasing chemical energy by transmitting a fluid through a catalytic bed. The fluid can be a peroxide such as hydrogen peroxide ($H_2O_2$) or a blend of fuels with the peroxide. Suitable blended materials that may be blended with the hydrogen peroxide include at least one of several other materials including methanol, methane, gasoline, diesel, oils or even sugar. The catalytic bed can be made up of particles of various transition metals or transition metal compounds including: aluminum, cobalt, gold, iron, magnesium, manganese, palladium, platinum, silver, and various compounds or combinations of these metals.

One challenge with thermites may be the difference in density between the first metal and the oxide of the second metal. This may cause them to separate during handling, for example while slurrying and placing in a fracture. The use of STS fluid would overcome such challenge. In some embodiments, the thermite might be used as the proppant, especially when the thermite is in the form of granules. In most embodiments of the invention, thermite granules of the same size as conventional hydraulic fracturing proppants may be appropriate. A multimodal fluid comprising about sand as the large particle combined with $Fe_2O_3$ and aluminum as the fine particles may be envisaged.

In some embodiments, it may be useful to bind the two (or more) components into a single particle. One way to do this is to use a binder to hold the chemicals together for example using sulfur. A suitable mixture may contain about iron oxide 70 wt %, about 23 wt % aluminum, and about 7 wt % sulfur. A further suitable binder may be plaster of paris, for example in a formulation of about 2 parts plaster of paris, about 2 parts aluminum, and about 3 parts iron oxide. Thermite may also be formed into granules by compressing it at high pressure. The resulting pellet will be strong and burns more slowly than thermite powder. Thermite may also be used in the form of thermate, an incendiary compound used for military applications. Thermate, whose primary component is thermite, also contains sulfur and optionally barium nitrate. An example may be thermate-TH3, a mixture of 68.7 wt % conventional aluminum/iron oxide thermite, 29.0 wt % barium nitrate, 2.0 wt % sulfur and 0.3 wt % binder. Addition of barium nitrate to thermite increases the exothermicity and reduces the ignition temperature. Optionally the fracture may be generated with conventional thermite and then thermite may be placed as the last of the fracturing slurry or may be placed in the borehole after the fracturing.

As has been mentioned, the powdered forms of the thermite components might not be suitable for optimal handling and placement in a non STS fracturing fluid. Furthermore, the particle sizes of the first metal and the oxide of the second metal may affect the rate of the thermite reaction. however, finer particles have greater surface areas and afford greater contact between the two reactive components. Consequently, the rate of reaction (and consequently the maximum temperature, since that is controlled by the rate of reaction and the rate of heat transfer away) may be controlled by variation of the particle sizes of each of the first metal and the oxide of the second metal. Whether bound or not, each component may vary from a fine powder to a coarse granule.

The current description may be applicable in any subterranean formation, especially hydrocarbon reservoirs. The formation may be primarily sandstone, primarily carbonate (either limestone or dolomite), shale, siltstones or coal. The formation fluid may be primarily water or primarily hydrocarbon (gas and/or condensate and/or oil). The stimulation may be needed because the formation inherently has too low a permeability or because it has been damaged. The wellbore may be substantially vertical, deviated, or partially horizontal, and may be open hole or cased, in which case it may be cemented. The reservoir may be overpressured or underpressured.

The fracture may be initiated with a pad and then propagated with a thermite laden slurry. Alternatively, the fracture may be propagated as a slick-water job (high flow rate of low-proppant slurry) and then widened (and optionally lengthened) with a thermite laden slurry; the slickwater treatment may be preceded with a pad. Thermite may optionally be left in the wellbore after fracturing, or the wellbore may be cleaned out. The fracture may be allowed to close or partially close before ignition or ignition may be effected above fracture pressure. The thermite slurry may also contain proppant; it may also contain high temperature-resistant materials such as sand or synthetic ceramics, and mixtures thereof. Optionally, alternating slugs of thermite and conventional proppant or of thermite and no proppant may be placed in the fracture to create reactive pillars, and these pillars may then be ignited with an overflush of reactive chemicals, for example a glycerine/permanganate mixture. As mentioned previously, the thermite may be used in a STS fluid; said STS fluid may be preceded or followed by either a pad or slickwater.

Conventional surface equipment may be used as thermite is generally safe under normal wellsite conditions. Besides STS fluid, any fracturing fluid may be used to slurry the thermite and generate the fracture: for example, gelled oil, polymer-viscosified water (including for example seawater, freshwater, and brine) and water viscosified with a viscoelastic surfactant. The slurry may contain other common fracturing fluid additives as needed, such as biocides and friction reducers. Some additives often used may not be needed, for example iron, clay and sulfur control agents.

Since the thermite reaction releases a large quantity of energy, it may be important that the effect of the treatment be contained in the region of interest. A number of methods may be employed to prevent blowouts when the thermite is ignited, and to ensure that the energy is used for fracturing. After the placement of the thermite mixture in the fracture, with some optionally in the wellbore, and before reaction initiation, the wellbore may be filled or partially filled with dense brine sufficient to withstand any gas kick generated by the thermite event. After the placement of the thermite mixture, and before reaction initiation, the wellbore may be filled, or partially filled, with a slurry or fluid containing hollow glass spheres. These may, for example, be hollow glass spheres such as those manufactured by 3M (St. Paul, Minn., U.S.A.) under the trade name GLASS BUBBLES, or those that are a waste product from fly ash. They may also be perlite hollow spheres (available from The Schundler Company, Metuchen, N.J., U.S.A.) that are discreet bubbles containing a multi-cellular core. The bubbles may optionally be suspended in a dense brine. Alternatively a foamed fluid may be used to fill or partially fill the wellbore. If a shockwave or kick is produced from the thermite event, then the collapse of the solid bubbles or of the foam will prevent damage to the wellhead. Alternatively, the wellbore may be filled, or partially filled, with sand or a similar material. A plug, in the wellbore or in the fracture immediately adjacent the wellbore, of material that melts and seals off the wellbore from the formation may also be deployed with the other control methods. Finally, of course packers may be placed above and/or below the zone to be fractured.

Without wishing to be bound by any theory, it is believed that the thermite reaction creates a fracture filled with molten metal, for example molten iron, that further reacts with the rock matrix, the native fluids, and the residual fracturing fluid. The temperature of a thermite reaction is very high, up to at least 2500° C. or higher; the actual temperature depends upon he thermite chosen, whether or not it is modified (for example by the addition of sulfur and/or a nitrate) and the amount of thermite and the rate of heat transfer away into the matrix. The heat significantly disrupts the adjacent formation, due to thermal shock, to the violent release of gases, and to temperature induced reactions, such as the maturation of clay and carbonate minerals. The melting point of quartz is only about 1715-1725° C.; calcium carbonate dissociates at about 825° C. and calcium sulfate dissociates at about 900° C.; dolomite melts at about 2570-2800° C.; kaolinite melts at 1785° C.; of course these are data for pure materials and impure or mixed materials will generally have lower reaction or melting temperatures. In the portion of the formation immediately adjacent to the thermite pack some minerals may decompose, some may melt, and some may be sintered. Sintering occurs if the temperature is below the melting point; the minerals will adhere strongly to one another and there will be a local decrease in volume and porosity. Thermite and liquid water react in a violent phreatomagmatic reaction (a steam explosion when liquid water directly contacts the surface of a molten metal). At a distance a little further away from the thermite in the fracture, rather than melting the minerals, at progressively lower temperatures other reactions and effects occur, including driving off of connate water, hydrocarbons and fracture fluid, desorbtion and desorption of gases and liquids, and maturation of minerals and kerogens. The net result is that all these effects creates a region or lens of rock immediately surrounding the fracture that is glass-like and not porous, although it might be cracked; further away a large region of the rock is shattered, or micro-fractured, and much more conductive to oil and gas than before the treatment.

Furthermore, the thermite reaction may drive supercritical water (also known as supercritical steam), among other fluids, a considerable distance from the initial fracture. This supercritical steam reacts with hydrocarbons (kerogen, coal, oil, condensate, and gas) in the formation to break them down in a process called steam reforming and produces primarily smaller hydrocarbons, carbon monoxide and hydrogen (which at the high temperatures may further break down additional hydrocarbons). This process chemically and physically improves hydrocarbon production.

The effects of such a treatment may be very beneficial, especially in tight gas formations, such as shale, or in coal seam formations. The region of shattered or micro-fractured rock will be sufficiently permeable to pass fluids, and it will be significantly more extensive than would be the width of a conventional fracture in the same rock.

The effects of such a treatment may also be beneficial in heavy oil formations produced by cold heavy oil production with sand (CHOPS). The lens of shattered material surrounding the cooled core of the fracture could readily produce back both solids and liquids.

It is likely that the high temperature and possibly violent reaction will damage the connection between the stimulated region and the original wellbore. Whether or not the thermite-affected region is in suitable fluid communication with the original wellbore may be determined by injecting a fluid into the original wellbore and conducting a conventional pressure analysis. If the thermite-affected region is not in suitable fluid communication with the original wellbore, a means of reconnecting the thermite-affected region to the surface is important to the productivity of the well and to the utility of the process. Therefore, it may be necessary to ream, reperforate or restimulate the zone with a conventional propped hydraulic fracture or to redrill and recomplete the original wellbore, or to intersect the thermite affected region with a second wellbore, with a lateral or spur from the original wellbore, or with a hydraulic fracture initiated from the original wellbore (or lateral or spur) or from a second wellbore. If the initial plan is to drill a second wellbore, the original wellbore need not be completed as it would be if it were to be used for production.

For most of the above methods of connecting to the surface, mapping of the thermite-affected region would be beneficial. This may be done after the fracturing treatment and before the thermite ignition. There are a number of methods that may be used, including for example pressure analysis, tiltmeter observational analysis, and microseismic monitoring of hydraulic fracture growth, which all use de-convolution of the acquired data through the use of models to infer the fracture geometry. Other methods are given in U.S. Pat. No. 7,134,492, which describes a method of assessing the geometry of a fracture using explosive, implosive or rapidly combustible particulate material added to the fracturing fluid and pumped into the fracture during the stimulation treatment. In U.S. Pat. No. 7,134,492, the particles are detonated or ignited during the treatment, subsequent to the treatment during closure, or after the treatment. In the present invention, the particles are detonated or ignited during the fracturing step, after the fracturing step but before the thermite ignition step, or by the thermite reaction itself. The acoustic signal generated by these discharges is detected by geophones placed on the ground surface, in a nearby observation well, or in the original well. The technique is similar to that currently employed in microseismic detection—however the signal is guaranteed to originate in the thermite-affected region. Other known methods of evaluating formations may be used to aid in reconnecting the thermite-affected region to a wellbore, such as detection tools (that detect, for example, gamma rays, magnetic fields, and temperature) and tools that both emit and detect electromagnetic radiation, neutrons, or sound.

The described methods may be carried out such that a major portion of the thermite mixture that is used to fracture a formation is granular and the size of proppants (both the first metal and the oxide of the second metal are granular, or the two are formed into granules separately or together) and a minor portion of the thermite mixture is a powder the size of a fluid loss additive (either both or either of the first metal and the oxide of the second metal). Thus the thermite mixture acts both as proppant and as fluid loss additive, as are commonly used in conventional fracturing. As examples: 1) conventional proppant and granular thermite are mixed to form the proppant; 2) conventional proppant is used with powdered thermite; and 3) conventional fluid loss additive is used with granular thermite as proppant. All combinations of powdered first metal, granular first metal, powdered oxide of second metal, granular oxide of second metal, conventional proppant, and conventional fluid loss additive, may be used, provided only that the final ratio of the first metal to the oxide of the second metal is a suitable thermite, that the total amount of the thermite components is sufficient for the reaction, and that the components of the thermite mixture are physically close enough to one another to sustain the reaction.

In some embodiments, small amounts of thermite, are placed in a fracture as a method of increasing the overall temperature of the fluid in the fracture in order to initiate or catalyze secondary reactions in the fracture or wellbore. As an example, for low temperature carbonate formations (for example about 79° C. (about 175° F.)), small amounts of thermite can be distributed throughout a recently created hydraulic fracture and then activated to increase the temperature of the fracturing fluid that also contains solid acid-precursor pellets such as polylactic acid (PLA) pellets. The increased temperature allows the PLA to convert to lactic acid that etches the carbonate walls of the fracture and creates a highly conductive channel. Other solid acid-precursors are well known and may be used. As a second example, oxidizers may require heat to initiate the reaction required to breakdown polymers used as fracturing fluids. Small amounts of thermite could again be distributed throughout a recently created fracture and then activated to activate the oxidation reaction. This type of activation could take place in a well having a temperature below 52° C. (about 125° F.) where ammonium persulfate is added as the oxidizing breaker.

Small amounts of isotopic elemental tracers, for example radioactive strontium, may be included in the thermite mixture. Detection of these materials in produced fluids is used to evaluate the performance of the treatment.

Although the preceding description has been described herein with reference to particular means, materials and embodiments, it is not intended to be limited to the particulars disclosed herein; rather, it extends to all functionally equivalent structures, methods and uses, such as are within the scope of the appended claims.

The invention claimed is:

1. A method of stimulating a subterranean formation penetrated by a wellbore through a wellhead, the method comprising:

fracturing the formation;

introducing a slurry into a fracture in the formation, wherein the slurry comprises a carrier fluid and thermite dispersed in the carrier fluid, wherein the thermite comprises a plurality of solids comprising a first metal and an oxide of a second metal, and wherein introducing the thermite into the fracture comprises sequentially introducing the plurality of solids into the fracture;

igniting the thermite within the fracture by a temperature reaction;

allowing the fracture to close before igniting the thermite within the fracture by the temperature reaction; and fluidly contacting a thermite-affected region to a surface of the formation.

2. The method of claim 1, wherein the thermite is ignited by way of a downhole tool.

3. The method of claim 1, further comprising mapping the thermite-affected region.

4. The method of claim 3, wherein the thermite-affected region is mapped with the use of micro seismic or tilt meter detection or both.

5. The method of claim 1, wherein at least a portion of the thermite is granular.

6. The method of claim 1, wherein at least a portion of the thermite is a powder.

7. The method of claim 1, wherein the thermite comprises at least aluminum.

8. The method of claim 1, wherein the introduction of thermite is alternated with injection of solids not comprising thermite.

9. The method of claim 1, wherein heat of the temperature reaction is configured to initiate a reaction of a solid in the fracture, wherein the solid is not a component of the thermite.

10. The method of claim 9 wherein the solid comprises a solid acid-precursor.

11. The method of claim 1, wherein the carrier fluid comprises an energized fluid, and the thermite is pumped in the energized fluid.

12. The method of claim 1, wherein fluidly contacting a thermite-affected region comprises intersecting the thermite-affected region with a second wellbore.

13. The method of claim 1, wherein the slurry comprises a solids volume fraction that is less than or equal to a packed volume fraction of the slurry.

14. A method of stimulating a subterranean formation penetrated by a wellbore through a wellhead, the method comprising:

fracturing the formation;

introducing a slurry comprising a carrier fluid and a multimodal blend of solids dispersed in the carrier fluid into a fracture in the formation, wherein the multimodal blend of solids comprises a thermite, and wherein the thermite comprises a first metal and an oxide of a second metal;

igniting the thermite within the fracture by a temperature reaction;

allowing the fracture to close before igniting the thermite within the fracture by the temperature reaction; and fluidly contacting a thermite-affected region to a surface of the formation.

15. The method of claim 14, wherein the multimodal blend of solids comprises proppant and the thermite.

16. The method of claim 14, wherein fluidly contacting a thermite-affected region comprises intersecting the thermite-affected region with a second wellbore.

17. The method of claim 14, wherein the igniting the thermite within the fracture by a temperature reaction comprises igniting a mixture of compounds, wherein igniting the mixture of compounds causes the thermite to be ignited.

18. The method of claim 14, wherein the slurry comprises a solids volume fraction of at least 0.4.

19. The method of claim 14, wherein the slurry comprises a viscosifier.

* * * * *